United States Patent [19]

Iino et al.

[11] Patent Number: 4,871,632

[45] Date of Patent: Oct. 3, 1989

[54] PHOTOSENSITIVE MEMBER COMPRISING CHARGE GENERATING LAYER AND CHARGE TRANSPORTING LAYER

[75] Inventors: Syuji Iino, Hirakata; Izumi Osawa, Ikeda; Hideo Hotomi, Suita, all of Japan

[73] Assignee: Minolta Camera Kabushiki Kaisha, Osaka, Japan

[21] Appl. No.: 101,281

[22] Filed: Sep. 25, 1987

[30] Foreign Application Priority Data

| | | | |
|---|---|---|---|
| Sep. 26, 1986 | [JP] | Japan | 61-229392 |
| Sep. 26, 1986 | [JP] | Japan | 61-229393 |
| Sep. 26, 1986 | [JP] | Japan | 61-229396 |
| Sep. 26, 1986 | [JP] | Japan | 61-229397 |
| Sep. 26, 1986 | [JP] | Japan | 61-229431 |
| Sep. 26, 1986 | [JP] | Japan | 61-229432 |
| Sep. 26, 1986 | [JP] | Japan | 61-229435 |
| Sep. 26, 1986 | [JP] | Japan | 61-229436 |
| Sep. 26, 1986 | [JP] | Japan | 61-229439 |
| Sep. 26, 1986 | [JP] | Japan | 61-229440 |

[51] Int. Cl.[4] ..... G03G 5/14; G03G 5/082

[52] U.S. Cl. ..... 430/58; 430/66; 430/95

[58] Field of Search ..... 430/58, 60, 66

[56] References Cited

U.S. PATENT DOCUMENTS

| | | | |
|---|---|---|---|
| 3,956,525 | 5/1976 | Yasuba | 427/41 |
| 4,366,208 | 12/1982 | Akai et al. | 428/421 |
| 4,394,425 | 7/1983 | Shimizu et al. | 430/65 |
| 4,491,626 | 1/1985 | Kawamura et al. | 430/69 |
| 4,495,262 | 1/1985 | Matsuzaki et al. | 430/58 |
| 4,513,073 | 4/1985 | Jeffrey et al. | 430/65 |
| 4,518,670 | 4/1985 | Matsuzaki et al. | 430/58 |
| 4,592,982 | 6/1986 | Saitoh et al. | 430/57 |
| 4,634,648 | 1/1987 | Jansen et al. | 430/84 |
| 4,675,265 | 6/1987 | Kazama et al. | 430/66 |
| 4,738,912 | 4/1988 | Iino et al. | 430/58 |
| 4,741,982 | 5/1988 | Iino et al. | 430/58 |
| 4,743,522 | 5/1988 | Iino et al. | 430/58 |
| 4,749,636 | 6/1988 | Iino et al. | 430/58 |

FOREIGN PATENT DOCUMENTS

| | | | |
|---|---|---|---|
| 3610076 | 10/1986 | Fed. Rep. of Germany | 430/66 |
| 58-88753 | 5/1983 | Japan . | |
| 58-154850 | 9/1983 | Japan . | |
| 59-28161 | 2/1984 | Japan . | |
| 59-38753 | 3/1984 | Japan . | |
| 59-136742 | 8/1984 | Japan . | |
| 60-249155 | 12/1985 | Japan . | |
| 61-94056 | 5/1986 | Japan . | |

OTHER PUBLICATIONS

Journal of Applied Polymer Science, vol. 17, 1973.

"A C-nmr Investigation of Plasma Polymerized Ethane, Ethylene, and Acetylene" Dilks et al, Journal of Polymer Science, vol. 19, 1981.

*Primary Examiner*—Roland E. Martin

*Attorney, Agent, or Firm*—Burns, Doane, Swecker & Mathis

[57] ABSTRACT

A photosensitive member of the present invention comprises an electrically conductive substrate, a hydrogenated and/or halogenated amorphous silicon:germanium charge generating layer and a hydrogen-containing amorphous carbon charge transporting layer which contains halogen and oxygen and/or nitrogen. The charge generating layer may further contain various elements such as boron or phosphorus, oxygen, nitrogen and carbon as a chemical modifier.

11 Claims, 3 Drawing Sheets

PHOTOSENSITIVE MEMBER COMPRISING CHARGE GENERATING LAYER AND CHARGE TRANSPORTING LAYER

BACKGROUND OF THE INVENTION

1. Field of the Invention

The present invention relates to a photosensitive member of the function-separated type comprising an amorphous silicon:germanium layer as a charge generating layer and a hydrogen-containing amorphous carbon layer as a charge transporting layer.

2. Description of the Prior Art

Remarkable progress has been made in the application of electrophotographic techniques since the invention of the Carlson process. Various materials have also been developed for use in electrophotographic photosensitive members.

Conventional photoconductive materials chiefly include inorganic compounds such as amorphous selenium, selenium-arsenic, selenium-tellurium, zinc oxide, amorphous silicon and the like, and organic compounds such as polyvinylcarbazole, metal phthalocyanine, disazo pigments, tris-azo pigments, perillene pigments, triphenymethanes, triphenylamines, hydrazones, styryl compounds, pyrazolines, oxazoles oxadiazoles and the like. The structures of photosensitive members include, for example, those of the single-layer type wherein such a material is used singly, the binder type wherein the material is dispersed in a binder, and the function-separated type comprising a charge generating layer and a charge transporting layer.

However, conventional photoconductive materials have various drawbacks. For example, the above-mentioned inorganic materials, except for amorphous silicon (a-Si), are harmful to the human body.

The electrophotographic photosensitive member, when employed in a copying apparatus, must always have stabilized characteristics even if it is subjected to the severe environmental conditions of charging, exposure, developing, image transfer, removal of residual charges and cleaning. However, the above described organic compounds have poor durability and many unstable properties.

In order to eliminate these drawbacks, progress has been made in recent years in the application of a-Si formed by the glow discharge process to an electrophotographic photosensitive members as a material with reduced harmfulness, higher sensitivity, higher hardness (such as more than 7H level of the JIS standards for pencil lead hardness) and higher durability. Nevertheless, a-Si is hazardous to manufacture since it requires highly ignitable silane gas as its starting material. Moreover, a-Si requires a large quantity of silane gas which is expensive, rendering the resulting photosensitive member exceedingly more costly than conventional photosensitive members. The manufacture of photosensitive members of a-Si involves many disadvantages. For example, a-Si is low in film-forming speed and releases a large amount of explosive undecomposed silane products in the form of particles when forming a film. Such particles, when incorporated into the photosensitive member being produced, adversely influences the quality of images obtained. Further, a-Si has a low chargeability due to its original high relative dielectric constant. This necessitates the use of a charger of higher output for charging the a-Si photosensitive member to a predetermined surface potential in the copying apparatus.

On the other hand, it has been proposed in recent years to use amorphous carbon films as plasma-polymerized organic films for photosensitive members.

Plasma-polymerized organic films per se have been well-known for a long time. In Journal of Applied Polymer Science, Vol. 17, pp. 885–892, 1973, for example, M. Shen and A. T. Bell state that a plasma-polymerized organic film can be produced from the gas of any organic compound. The same authors discuss film formation by plasma polymerization in "Plasma Polymerization," published by the American Chemical Society in 1979.

However, the plasma-polymerized organic films prepared by the conventional process have been used only as insulating films. They are thought to be insulating films having a specific resistivity of about $10^{16}$ ohm-cm like usual polyethylene films, or are used, as recognized, at least as such. The use of the film in electrophotographic photosensitive members is based on the same concept; the film has found limited use only as an undercoat or overcoat serving solely as a protective layer, adhesion layer, blocking layer or insulating layer.

For example, Unexamined Japanese Patent Publication SHO 59-28161 discloses a photosensitive member which comprises a plasma-polymerized high polymer layer of reticular structure formed on a substrate and serving as a blocking-adhesion layer, and an a-Si layer formed on the polymer layer. Unexamined Japanese Patent Publication SHO 59-38753 discloses a photosensitive member which comprises a plasma-polymerized film having a thickness of 10 to 100 angstroms and formed over a substrate as a blocking-adhesion layer, and an a-Si layer formed on the film, the plasma-polymerized film being prepared from a gas mixture of oxygen, nitrogen and a hydrocarbon and having a high resistivity of $10^{13}$ to $10^{15}$ ohm-cm. Unexamined Japanese Patent Publication SHO 59-136742 discloses a photosensitive member wherein an aluminum substrate is directly coated with a carbon film having a thickness of about 1 to about 5 microns and serving as a protective layer for preventing aluminum atoms from diffusing through an a-Si layer formed over the substrate when the member is exposed to light. Unexamined Japanese Patent Publication SHO 60-63541 discloses a photosensitive member wherein a diamond-like carbon film, 200 angstroms to 2 microns in thickness, is interposed between an aluminum substrate and an overlying a-Si layer to serve as an adhesion layer to improve the adhesion between the substrate and the a-Si layer. The publication says that the film thickness is preferably up to 2 microns in view of the residual charge.

These disclosed inventions are all directed to a so-called undercoat provided between the substrate and the a-Si layer. In fact, these publications mention nothing whatever about charge transporting properties, nor do they offer any solution to the foregoing substantial problems of a-Si.

Furthermore, U.S. Pat. No. 3,956,525, for example, discloses a photosensitive member of the polyvinylcarbazole-selenium type coated with polymer film having a thickness of 0.1 to 1 microns and formed by glow discharge polymerization as a protective layer. Unexamined Japanese Patent Publication SHO 59-214859 discloses a technique for protecting the surface of an a-Si photosensitive member with an approximately 5-micron-thick film formed by plasma-polymerizing an organic hydrocarbon monomer such as styrene or acetylene. Unexamined Japanese Patent Publication SHO 60-61761 discloses a photosensitive member having a diamond-like carbon thin film 500 angstroms to 2 microns thick and serving as a surface protective layer, it being preferred that the film thickness be up to 2 microns in view of trasmittancy. Unexamined Japanese Patent Publication SHO 60-249115 discloses a technique for forming a film of amorphous carbon or hard carbon with a thickness of about 0.05 to about 5 microns for use as a surface protective layer. The publications states that the film adversely affects the activity of the protected photosensitive member it exceeds 5 microns in thickness.

These disclosed inventions are all directed to a so-called overcoat formed over the surface of the photosensitive member. The publications disclose nothing whatever about charge transporting properties, nor do they solve the aforementioned substantial problems of a-Si in any way.

Unexamined Japanese Patent Publication SHO 50-46130 discloses an electrophotographic photosensitive member of the polyvinylcarbazole type which has a polymer film 0.001 to 3 microns thick, which is formed on its surface by being subjected to glow discharge polymerization. Nevertheless, the publication is totally mute about charge transporting properties, further failing to solve the foregoing substantial problems of a-Si.

With respect to a-Si, W. E. Spear and P. G. LeComber state in Philosophical Magazine, Vol. 33, pp. 935–949, 1976, that a-Si can control polarities. Since then, progress has been made in the application of a-Si to various photosensitive devices.

For example, Unexamined Japanese Patent Publication No. SHO 56-62254 discloses a photosensitive member of a-Si containing carbon. This reference aims at adjusting the photoconductivity of a-Si by incorporating carbon therein. The a-Si layer needed has a large thickness.

Thus, the conventional plasma-polymerized organic films for use in electrophotographic photosensitive members are used as undercoats or overcoats because of their insulating properties and need not have a carrier transporting function. Accordingly, the films used have limited the thicknesses to a very small value up to about 5 microns at the largest. Carriers pass through the film owing to a tunnel effect, while if the tunnel effect is not expectable, the film used has such a small thickness that will not pose problems due to the occurrence of a residual potential. Further, the conventional a-Si layer, for use in electrophotographic photosensitive members, are used with a large thickness, causing disadvantages in view of cost or productivity.

SUMMARY OF THE INVENTION

The main object of the present invention is to provide a photosensitive member having excellent electrophotographic characteristics and capable of giving satisfactory images.

Another object of the invention is to provide a photosensitive member comprising a charge transporting layer which has excellent charge transportability and charging characteristics and a charge generating layer which exhibits distinct photoconductive properties.

Still another object of the invention is to provide a photosensitive member which is highly resistant to moisture and weather and has excellent transparency.

These and other objects of the invention can be accomplished by providing a photosensitive member comprising an electrically conductive substrate, a charge generating layer comprising hydrogenated amorphous silicon containing germanium or fluorinated amorphous silicon containing germanium, and a charge transporting layer comprising amorphous carbon containing hydrogen and halogen, and further oxygen and/or nitrogen.

DETAILED DESCRIPTION OF THE INVENTION

Figure 1:
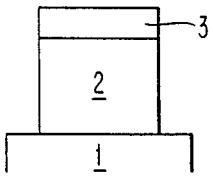
FIGS. 1 to 6 are diagrams showing photosensitive members embodying the invention.

The photosensitive member embodying the present invention is characterized in that the member comprises a hydrogenated or fluorinated amorphous silicon:germanium layer as a charge generating layer (hereinafter referred to as a-Si layer) and an amorphous carbon layer containing hydrogen and halogen, and further oxygen and/or nitrogen and prepared by applying a glow discharge with plasma polymerization as a charge transporting layer (hereinafter referred to as "a-C layer").

We have conducted research on the application of hydrogen-containing amorphous carbon layers to photosensitive members of the function-separated type and found that a hydrogenated amorphous carbon layer containing halogen and oxygen and/or nitrogen, which was originally thought to be an insulating layer, exhibits the ability to transport charges, readily showing satisfactory electrophotographic characteristics, when laminated to a hydrogenated or fluorinated amorphous silicon:germanium layer. Although much still remains to be clarified on the detailed theoretical interpretation of this finding, the result will presumably be attributable to the following reason. The band structure formed by electrons in a relatively unstable state, such as $\pi$-electrons, unpaired electrons, remaining free radicals and the like, which are captured in the hydrogenated amorphous carbon layer containing halogen and oxygen and/or nitrogen has, at the conduction band or charge electron band, an energy level close to that of the band formed by the hydrogenated or fluorinated amorphous silicon:germanium. Therefore the carriers produced in the hydrogenated or fluorinated amorphous silicon:germanium layer can be readily injected into the hydrogenated amorphous carbon layer containing halogen and oxygen and/or nitrogen, and permits satisfactory travel of the carriers therethrough by the action of the above-mentioned electrons of relatively unstable energy states.

The carbon and hydrogen contents of the a-C layer of the invention can be determined by a usual method of elementary analysis, for example, by organic elementary (CHN) analysis.

The charge generating layer exhibits distinct photoconductive properties when exposed to visible light in the wavelength vicinity of semiconductor laser beams and can have an exceedingly smaller thickness than conventional amorphous silicon photosensitive members when serving its function. The charge transporting layer does not exhibit distinct photoconductive properties when exposed to visible light or light in the wavelength vicinity of semiconductor laser beams, but has the ability to transport charges and has excellent characteristics for use in electrophotographic photosensitive members, e.g. in chargeability, durability, resistance to moisture, weather and environmental pollution, and transmittance. The layer also affords a high degree of freedom in providing laminate structures for use as photosensitive members of the function-separated type.

According to the present invention, hydrocarbons are used as organic gases for forming the a-C layer. These hydrocarbons need not always be in a gaseous phase at room temperature and atmospheric pressure but can be in a liquid or solid phase insofar as they can be vaporized on melting, evaporation or sublimation, for example, by heating or with a vacuum. Examples of useful hydrocarbons are saturated hydrocarbons, unsaturated hydrocarbons, alicyclic hydrocarbons, aromatic hydrocarbons and the like. Such hydrocarbons are usable in combination.

A wide variety of hydrocarbons are usable. Examples of useful saturated hydrocarbons are normal paraffins such as methane, ethane, propane, butane, pentane, hexane, heptane, octane, nonane, decane, undecane, dodecane, tridecane, tetradecane, pentadecane, hexadecane, heptadecane, octadecane, nonadecane, eicosane, heneicosane, docosane, tricosane, tetracosane, pentacosane, hexacosane, heptacosane, octacosane, nonacosane, triacontane, dotriacontane, pentatriacontane, etc.; isoparaffins such as isobutane, isopentane, neopentane, isohexane, neohexane, 2,3-dimethylbutane, 2-methylhexane, 3-ethylpentane, 2,2-dimethylpentane, 2,4-dimethylpentane, 3,3-dimethylpentane, tributane, 2-methylheptane, 3-methylheptane, 2,2-dimethylhexane, 2,2,5-dimethylhexane, 2,2,3-trimethylpentane, 2,2,4-trimethylpentane, 2,3,3-trimethylpentane, 2,3,4-trimethylpentane, isononane, etc.; and the like.

Examples of useful unsaturated hydrocarbons are olefins such as ethylene, propylene, isobutylene, 1-butene, 2-butene, 1-pentene, 2-pentene, 2-methyl-1-butene, 3-methyl-1-butene, 2-methyl-2-butene, 1-hexene, tetramethylethylene, 1-heptene, 1-octene, 1-nonene, 1-docene and the like; diolefins such as allene, methyl-allene, butadiene, pentadiene, hexadiene, cyclopentadiene and the like; triolefins such as ocimene, alloocimene, myrcene, hexatriene and the like; acetylene, butadiyne, 1-pentadiyne, 2,4-hexadiyne, methylacetylene, 1-butyne, 2-butyne, 1-pentyne, 1-hexyne, 1-heptyne, 1-octyne, 1-nonyne, 1-decyne and the like.

Examples of useful alicyclic hydrocarbons are cycloparaffins such as cyclopropane, cyclobutane, cyclopentane, cyclohexane, cycloheptane, cyclooctane, cyclononane, cyclodecane, cycloundecane, cyclododecane, cyclotridecane, cyclotetradecane, cyclopentadecane, cyclohexadecane and the like; cycloolefins such as cyclopropene, cyclobutene, cyclopentene, cyclohexene, cycloheptene, cyclooctene, cyclononene, cyclodecene and the like; terpenes such as limonene, terpinolene, phellandrene, sylvestrene, thujene, carene, pinene, bornylene, camphene, fenchene, cyclofenchene, tricyclene, bisabolene, zingiberene, curcumene, humulene, cadinenesesquibenihene, selinene, caryophyllene, santalene, cedrene, camphorene, phyllocladene, podocarprene, mirene and the like; steroids; etc.

Examples of useful armatoc hydrocarbons are benzene, toluene, xylene, hemimellitene, pseudocumene, mesitylene, prehnitene, isodurene, durene, pentamethylbenzene, hexamethylbenzene, ethylbenzene, propylbenzene, cumene, styrene, biphenyl, terphenyl, diphenylmethane, triphenylmethane, dibenzyl, stilbene, indene, naphthalene, tetralin, anthracene, phenanthrene and the like. In addition to hydrocarbons, also usable are compounds, such as alcohols, ketones, ethers and esters, which can be converted to carbon.

While the amount of hydrogen atoms to be contained in the a-C layer of the present invention is invariably dependent on the process by which the layer is prepared, i.e. the glow discharge process, the hydrogen content is generally 30 to 60 atomic % based on the combined amount of carbon and hydrogen atoms present. The carbon and hydrogen contents of the a-C layer can be determined by a usual method of organic elementary analysis, for example, by ONH analysis.

The hydrogen content of the a-C layer of the invention is variable in accordance with the film forming apparatus and film forming conditions. The hydrogen content can be decreased, for example, by elevating the substrate temperature, lowering the pressure, reducing the degree of dilution of the starting materials, applying a greater power, decreasing the frequency of the alternating electric field to be set up, increasing the intensity of a d.c. electric field superposed on the alternating electric field or a desired combination of these procedures.

It is suitable that the a-C layer serving as the charge trannsporting layer of the invention be 5 to 50 microns, preferable 7 to 20 microns, thick for use in the usual electrophotographic process. Thicknesses smaller than 5 microns result in a lower charge potential, failing to give a sufficient copy image density, whereas thicknesses larger than 50 microns are not desirable in view of productivity. The a-C layer is high in transmittancy, dark resistivity and charge transportability, traps no carriers even when not smaller than 5 microns thick as mentioned above, and contributes to light decay.

According to the present invention, the starting material gases are made into an a-C layer, most preferably via a plasma which is produced by d.c. low- or high-frequency, microwave or a like plasma process. Alternatively, the layer may be formed via ions produced by ionization deposition, ion-beam deposition or a like process, or via neutral particles produced by the vacuum evaporation process, sputtering process or the like. These processes may be used in combination.

According to the present invention, halogen compounds are used in addition to hydrocarbons in order to incorporate atoms of a halogen into the a-C layer. The term "halogen" as used herein refers to fluorine, chlorine, bromine and iodine. The incorporation of halogen in the a-C layer improves charge transportability and effectively prevents residual potential. The halogen compounds to be used need not always be in a gaseous phase at room temperature and atmospheric pressure. A liquid or solid phase can be provided they can be vaporized on melting, evaporation or sublimation, for example, by heating or in a vacuum. While halogens such as fluorine, chlorine, bromine and iodine are usable in this invention, examples of useful halogen compounds are inorganic compounds such as hydrogen fluoride, chlorine fluoride, bromine fluoride, iodine fluoride, hydrogen chloride, bromine chloride, iodine chloride, hydrogen bromide, iodine bromide and hydrogen iodide; and organic compounds such as alkyl halides, aryl halides, styrene halides, polymethylene halides and haloforms. Examples of such alkyl halides are methyl fluoride, methyl chloride, methyl bromide, methyl iodide, ethyl fluoride, ethyl chloride, ethyl bromide, ethyl iodide, propyl fluoride, propyl chloride, propyl bromide, propyl iodide, butyl fluoride, butyl chloride, butyl bromide, butyl iodide, amyl fluoride, amyl chloride, amyl bromide, amyl iodide, hexyl fluoride, hexyl chloride, hexyl bromide, hexyl iodide, heptyl fluoride, heptyl chloride, heptyl bromide, heptyl iodide, octyl fluoride, octyl chloride, octyl bromide, octyl iodide, nonyl fluoride, nonyl chloride, nonyl bromide, nonyl iodide, decyl fluoride, decyl chloride, decyl bromide, decyl iodide and the like. Examples of useful aryl halides are fluorobenzene, chlorobenzene, bromobenzene, iodobenzene, chlorotoluene, bromotoluene, chloronaphthalene, bromonaphthalene and the like. Examples of useful styrene halides are chlorostyrene, bromostyrene, iodostyrene, fluorostyrene and the like. Examples of useful polymethylene halides are methylene chloride, methylene bromide, methylene iodide, ethylene chloride, ethylene bromide, ethylene iodide, trimethylene chloride, trimethylene bromide, trimethylene iodide, dibutane chloride, dibutane bromide, dibutane iodide, dipentane chloride, dipentane bromide, dipentane iodide, dihexane chloride, dihexane bormide, dihexane iodide, diheptane chloride, diheptane bromide, diheptane iodide, dioctane chloride, dioctane bromide, dioctane iodide, dinonane chloride, dinonane bromide, didecane chloride, didecne iodide and the like. Examples of useful haloforms are fluoroform, chloroform, briomoform, iodoform and the like.

Halogen atoms are incorporated in the charge transporting layer of the invention as chemical modifying substances in an amount from 0.1 to 25 atomic %, preferably 0.3 to 15 atomic %, most preferably 0.5 to 10 atomic %, based on all the constituent atoms of the layer. The amount of halogen atoms in the a-C layer can be measured by general methods for element analysis, i.e., auger electron spectroscopy. If the halogen, atom content is higher than 25 atomic %, the halogen which assures suitable charge transportability and inhibition of residual potential when present in a suitable amount, will impair the chargeability, further acting to lower the dark resistivity with time and to diminish the charge retentivity during a several month storage. Moreover, an excessive halogen contents does not always assure satisfactory formation of the layer allowing layer separation or formation of oily or powdery layers. Therefore, the range of halogen doping in the a-C layer is important.

The quantity of halogen atoms to be contained in the layer as a chemically modifying substance is controlled primarily by varying the amount of the halogen compound introduced into a reactor for plasma polymerization. The use of an increased quantity of halogen compounds gives a higher halogen atom content in the a-C layer of the invention, whereas a decreased quantity of halogen compound results in a lower halogen atom content.

According to the present invention, oxygen compounds are used in addition to hydrocarbons and halogen compounds in order to incorporate oxygen atoms into the a-C layer. By incorporating oxygen into the a-C layer, the member exhibits high electric resistivity, reduced dark decay, and further stabilized electrostatic characteristics over a prolonged period of time, free of time lapse deterioration. The oxygen compound need not always be in a gas phase at room temperature and atmospheric pressure. A liquid or solid compound can be used provided the compound can be vaporized on melting, evaporation or sublimation, for example, when heated or subjected to a vacuum. While oxygen and ozone are usable for this purpose, examples of useful oxygen compounds are inorganic compounds such as water (water vapor), hydrogen peroxide, carbon monoxide, carbon dioxide, carbon suboxide; organic compounds having a functional group or linkage such as hydroxyl group (—OH), aldehyde group (—COH), acyl group (RCO— or —CRO), ketone group (CO), ether linkage (—O—), ester linkage (—COO—), oxygen-containing heterocyclic ring or the like. Examples of useful organic compounds having a hydroxyl group include alcohols such as methanol, ethanol, propanol, butanol, allyl alcohol, fluoroethanol, fluorobutanol, phenol, cyclohexanol, benzyl alcohol and furfuryl alcohol. Examples of useful organic compounds having an aldehyde group are formaldehyde, aetaldehyde, propioaldehyde, butyraldehyde, glyoxal, acrolein, benzaldehyde, furfural and the like. Examples of useful organic compounds having an acyl group are formic acid, acetic acid, propionic acid, butyric acid, valeric acid, palmitic acid, stearic acid, oleic acid, oxalic acid, malonic acid, succinic acid, benzoic acid, toluic acid, salicylic acid, cinnamic acid, naphthoic acid, phthalic acid, furoic acid and the like. Examples of suitable organic compounds having a ketone group are acetone, ethyl methyl ketone, methyl propyl ketone, butyl methyl ketone, pinacolone, diethyl ketone, methyl vinyl ketone, mesityl oxide, methylheptenone, cyclobutanone, cyclopentanone, cyclohexanone, acetophenone, propiophenone, butyrophenone, valerophenone, dibenzyl ketone, acetonaphthone, acetothienone, acetofuron and the like. Examples of useful organic compounds having an ether linkage are methyl ether, ethyl ether, propyl ether, butyl ether, amyl ether, ethyl methyl ether, methyl propyl ether, methyl butyl ether, methyl amyl ether, ethyl propyl ether, ethyl butyl ether, ethyl amyl ether, vinyl ether, allyl ether, methyl vinyl ether, methyl allyl ether, ethyl vinyl ether, ethyl allyl ether, anisole, phenetole, phenyl ether, benzyl ether, phenyl benzyl ether, naphthyl ether, ethylene oxide, propylene oxide, trimethylene oxide, tetrahydrofuran, tetrahydropyran, dioxane and the like. Examples of useful organic compounds having an ester linkage are methyl formate, ethyl formate, propyl formate, butyl formate, amyl formate, methyl acetate, ethyl acetate, propyl acetate, butyl acetate, amyl acetate, methyl propionate, ethyl propionate, propyl propionate, butyl propionate, amyl propionate, methyl butyrate, ethyl butyrate, propyl butyrate, butyl butyrate, amyl butyrate, methyl valerate, ethyl valerate, propyl valerate, butyl valerate, amyl valerate, methyl benzoate, ethyl benzoate, methyl cinnamate, ethyl cinnamate, propyl cinnamate, methyl salicylate, ethyl salicylate, propyl salicylate, butyl salicylate, amyl salicylate, methyl anthranilate, ethyl anthranilate, butyl anthranilate, amyl anthranilate, methyl phthalate, ethyl phthalate, butyl phthalate and the like. Examples of useful heterocyclic compounds are furan, oxazole, furazane, pyran, oxazine, morpholine, benzofuran, benzoxazole, chromene, chroman, dibenzofuran, xanthene, phenoxazine, oxirane, dioxirane, oxathiorane, oxadiazine, benzoisooxazole and the like.

Oxygen atoms, serving as a chemical modifying substance, are preferably incorporated in the a-C layer in an amount of 0.01 to 7.0 atomic %, more preferably 0.1 to 4.7 atomic %, based on all the constituent atoms of the layer. The amount of oxygen in the a-C layer can be measured by general methods for element analysis, i.e., auger electron spectroscopy. If the oxygen atom content exceeds 7.0 atomic %, the oxygen which assures suitable charge transportability when present in a suitable amount conversely, impairs chargeability, further acting to lower the resistivity of the layer.

Moreover, in the case of employing some oxygen source gases such as oxygen gas, ozone gas, carbon monoxide and the like, an etching effect is remarkably observed. If the flow rate of these gases is increased in order to increase the quantity of oxygen atoms in the a-C layer, film-forming speed lowers. This is undesirable in the formation of the charge transporting layer wherein a certain thickness is required. Therefore, the range of the oxygen atoms to be contained in the a-C layer is important.

The quantity of oxygen atoms to be contained in the layer and serving as a chemical modifying substance is controllable primarily by varying the amount of the oxygen compounds to be introduced into a reactor for plasma polymerization. Increasing the quantity of a oxygen compound gives a higher oxygen atom content to the a-C layer of the invention, whereas decreasing the quantity of a oxygen compound results in a lower oxygen atom content.

The a-C layer of the present invention may contain nitrogen atoms. Nitrogen compounds are used for incorporating nitrogen atoms in the a-C layer. The incorporation of nitrogen in the a-C layer gives high electric resistivity and reduced dark decay. Further, the member containing nitrogen in the a-C layer exhibits stabilized electrostatic characteristics over a prolonged period of time, free of deterioration, despite the lapse of time. The nitrogen compounds to be used need not always be in a gaseous phase at room temperature at atmospheric pressure but can be in a liquid or solid phase insofar as they can be vaporized on melting, evaporation or sublimation, for example, by heating or use of a vacuum. While nitrogen per se is usable, examples of useful nitrogen compounds include inorganic compounds such as ammonia, and organic compounds having a functional group or linkage such as amino group ($NH_2$), cyano group (—CN), nitrogen-containing hetero-cyclic ring or the like. Examples of useful organic compounds having an amino group are methylamine, ethylamine, propylamine, butylamine, amylamine, hexylamine, heptylamine, octylamine, nonylamine, decylamine, undecylamine, dodecylamine, tridecylamine, tetradecylamine, pentadecylamine, cetylamine, dimethylamine, diethylamine, dipropylamine, dibutylamine, diamylamine, trimethylamine, triethylamine, tripropylamine, tributylamine, triamylamine, allylamine, diallylamine, triallylamine, cyclopropylamine, cyclobutylamine, cyclopentylamine, cyclohexylamine, aniline, methylaniline, dimethylaniline, ethylaniline, diethylaniline, toluidine, benzylamine, dibenzylamine, tribenzylamine, diphenylamine, triphenylamine, naphthylamine, ethylenediamine, trimethylenediamine, tetramethylenediamine, pentamethylenediamine, hexamethylenediamine, diaminoheptane, diaminooctane, diaminononane, diaminodecane, phenylenediamine and the like. Examples of useful organic compounds having a cyano group are acetonitrile, propionitrile, butyronitrile, valeronitrile, capronitrile, enanthonitrile, caprylonitrile, pelargonnitrile, caprinitrile, lauronitrile, palmitonitrile, stearonitrile, crotononitrile, malonitrile, succinonitrile, glutaronitrile, adiponitrile, bezonitrile, tolunitrile, cyanobenzylic cinnamonitrile, naphthonitrile, cyanopyridine and the like. Examples of useful heterocyclic compounds are pyrrole, pyrroline, pyrrolidine, oxazole, thiazole, imidazole, imidazoline, imidazolidine, pyrazole, pyrazoline, pyrazolidine, triazole, tetrazole, pyridine, piperidine, oxazine, morpholine, thiazine, pyridazine, pyrimidine, pyrazine, piperazine, triazine, indole, indoline, benzoxazole, indazole, benzimidazole, quinoline, cinnoline, phthalazine, phthalocyanine, quinazoline, quinoxaline, carbazole, acridine, phenanthridine, phenazine, phenoxazine, indolizine, quinolizine, quinuclidine, naphthyridine, purine, pteridine, aziridine, azepine, oxadiazine, dithiazine, benzoquinoline, imidazothiazole and the like.

Nitrogen atoms, serving as another chemical modifying substance, are preferably incorporated in the a-C layer in an amount of 0.01 to 5.0 atomic %, more preferably 0.1 to 3.9 atomic %, based on all the constituent atoms of the layer. The amount of nitrogen in the a-C layer can be measured by general methods for element analysis, i.e., auger electron spectroscopy. If the nitrogen atom content exceeds 5.0 atomic %, the nitrogen, which assures suitable charge transportability when present in a suitable amount, impairs chargeability, further acting to lower the resistivity of the layer. Therefore, the range of nitrogen atoms to be contained in the a-C layer is important.

The quantity of nitrogen atoms to be contained in the layer and serving as a chemical modifying substance is controlled primarily by varying the amount of the nitrogen compound to be introduced into a reactor of plasma polymerization. The use of an increased quantity of a nitrogen compound gives a higher nitrogen atom content in the a-C layer of the invention, whereas a decreased quantity of nitrogen compound results in a lower nitrogen atom content.

According to the present invention, silane gas, disilane gas or silane fluoride gas is used for forming the a-Si layer. Further, a germane gas is used for incorporating germanium atoms into the layer.

The amount of germanium atoms to be contained in the a-Si layer of the invention is preferably up to 30 atomic % based on the combined amount of silicon atoms and germanium atoms. The germanium and silicon contents of the layer can be determined by a usual method of elementary analysis, e.g., Auger electron spectroscopy. The content of germanium atoms can be increased by supplying the germane gas at an increased flow rate for the formation of the layer. As the germanium content increases, the photosensitive member of the invention has improved long-wavelength sensitivity, making it possible to select a light source ranging from short to long wavelengths. However, if the germanium content exceeds 30 atomic %, reduced chargeability results, so that presence of excess of germanium atoms is undesirable. Accordingly, the amount of germanium atoms contained in the a-Si layer of the invention is critical.

The a-Si layer of the present invention may contain boron atoms or phosphorus atoms. The incorporation of boron atoms or phosphorus atoms in the a-Si layer improves charge transportability and assures polarity adjustment. More specifically, by doping boron in the a-Si layer, charges of positive polarity serve as the majority carrier in the a-Si layer (P-type), and hence become more readily movable. On the other hand, by doping phosphorus in the a-Si layer, charges of negative polarity serve as the majority carrier in the a-Si layer (N-type), and hence become more readily movable. Consequently, the photosensitive member exhibits improved chargeability and transportability.

A phosphine gas, diborane gas or the like is used as a material gas for incorporating phosphorus atoms or boron atoms into the layer as a chemically modifying substance.

The amount of phosphorus atoms or boron atoms present in the a-Si layer as a chemical modifying substance according to the invention is up to 20,000 atomic ppm, preferably up to 150 atomic ppm, most preferably up to 100 atomic ppm based on all the constituent atoms of the layer. The phosphorus or boron content of the layer can be determined by a usual method of elementary analysis, e.g. Auger electron spectroscopy or IMA analysis. Whereas phosphorus atoms or boron atoms assure appropriate transportability or polarity control when present in a suitable amount, the phosphorus or boron content, if exceeding 20,000 atomic ppm, conversely reduces resistivity of the layer resulting in impaired chargeability.

The a-Si layer of the present invention may contain oxygen, nitrogen and carbon atoms as a chemical modifying substance. These atoms can be incorporated into the a-Si layer singly or in combinations with more than two atoms. The suitable incorporation of these atoms in the a-Si layer increases the electric resistivity of the a-Si layer so that high chargeability is obtained. Further, the member exhibits small dark decay. The above effects can be obtained even if the a-Si layer contains only one atoms among oxygen, nitrogen and carbon.

According to the present invention, oxygen gas or an oxygen compound gas, such as nitrous oxide gas, ozone gas or carbon monoxide gas, is used as a material gas for incorporating into the layer oxygen atoms serving as a chemical modifying substance. Examples of useful material gases for incorporating nitrogen atoms into the layer are nitrogen gas and nitrogen compound gases such as ammonia gas, nitrous oxide gas and nitrogen dioxide gas. Examples of material gases useful for incorporating carbon atoms into the layer are methane, ethane, ethylene, acetylene, propane, propylene, butane, butadiene, butadiyne, butene, carbon monoxide, carbon dioxide and like carbon compounds.

The amounts of oxygen, nitrogen and carbon atoms to be present as a chemically modifying substance in the invention are 0.001 to 1 atomic % for oxygen atoms, 0.001 to 3 atomic % for nitrogen atoms and 0.001 to 5 atomic % for carbon atoms respectively based on all constituent atoms of the a-Si layer. The contents of these atoms in the a-Si layer can be determined by a usual method of elementary analysis, e.g. Auger electron spectroscopy or IMA analysis. Although, oxygen, nitrogen and carbon atoms assure suitable chargeability when present in a very small amount, the contents of oxygen, nitrogen and carbon atoms, if exceeding 1 atomic %, 3 atomic % and 5 atomic % respectively, increases the electric resistivity of the a-Si layer to an excess entailing inefficient generation of optically excited carriers and impaired carrier mobility, thereby entailing lower sensitivity.

While the amount of hydrogen or fluorine atoms to be incorporated into the a-Si layer of the invention is invariably dependent on the process by which this layer is prepared, i.e. the glow discharge process, the hydrogen or fluorine content is generally 10 to 35 atomic % based on the combined amount of silicon atoms and hydrogen atoms or silicon atoms and fluorine atoms in the layer. The hydrogen or fluorine content of the layer can be determined by a usual method of elementary analysis, e.g. ONH analysis in metal or Auger electron spectroscopy.

It is suitable that the a-Si layer serving as the charge generating layer of the invention be 0.1 to 5 microns thick for use in the usual electrophotographic process. A layer less than 0.1 micron thick fails to fully absorb light and to generate a sufficient amount of charges, resulting in lower sensitivity, whereas thicknesses larger than 5 microns are undesirable in view of productivity. The a-Si layer has high ability to generate charges, and when forming a laminate structure along with the a-C layer as the most distinct feature of the invention, the a-Si layer assures efficient injection of the resulting carriers into the a-C layer, contributing to satisfactory light decay.

According to the present invention, the a-Si layer is prepared from the desired gaseous materials by the same process as the a-C layer.

The quantities of oxygen atoms, nitrogen atoms, carbon atoms, and phosphorus or boron atoms to be incorporated into the a-Si layer as chemically modifying substances according to the invention are respectively controllable primarily by varying the amounts of oxygen gas or oxygen compound gas, nitrogen gas or nitrogen compound gas, carbon compound gas, and phosphine gas or diborane gas to be introduced into the reactor for plasma polymerization. The use of increased amounts of oxygen gas or oxygen compound gas, nitrogen gas or nitrogen compound gas, carbon compound gas, and phosphine gas or diborane gas gives the a-Si layer of the invention higher oxygen, nitrogen, carbon, and phosphorus or boron contents, respectively, whereas use of a decreased amount of such a gas gives the layer a lower content of the element concerned.

The photosensitive member of the present invention comprises a charge generating layer and a charge transporting layer of the type described above, which are formed in a superposed structure suitably determined as required.

Figure 2:
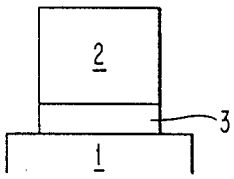
Figure 3:
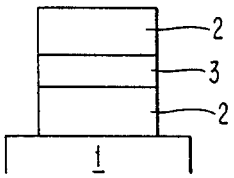

FIG. 1 shows a photosensitive member of one type comprising an electrically conductive substrate 1, a charge transporting layer 2 formed on the substrate and a charge generating layer 3 formed on the layer 2. FIG. 2 shows another type comprising an electrically conductive substrate 1, a charge generating layer 3 on the substrate and a charge transporting layer 2 on the layer 3. FIG. 3 shows another type comprising an electrically conductive substrate 1, and a charge transporting layer 2, a charge generating layer 3 and another charge transporting layer 2 formed over the substrate and arranged one over another.

These photosensitive members are used, for example, by positively charging the surface with a corona charger or the like and exposing the charged surface to an optical image. In the case of FIG. 1, the holes then generated in the charge generating layer 3 travel through the charge transporting layer 2 toward the substrate 1. In FIG. 2, the electrons generated in the charge generating layer 3 travel through the charge transporting layer 2 toward the surface of the photosensitive member. In FIG. 3, the holes generated in the charge generating layer 3 travel through the lower charge transporting layer 2 toward the substrate 1, and at the same time, the electrons generated in the charge generating layer 3 travel through the upper transporting layer 2 toward the surface of the member. Consequently, an electrostatic latent image is formed, with satisfactory light decay assured. Conversely, when the surface of the photosensitive member is negatively charged and then exposed, the electron and the hole may replace each other with respect to the carrier travel and the above behavior interpretation. With the structures of FIGS. 2 and 3, the image projecting light passes through the charge transporting layer, which nevertheless has high transmittancy, permitting satisfactory formation of latent image.

Figure 4:
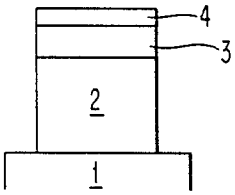

FIG. 4 shows another arrangement comprising an electrically conductive substrate 1; and a charge transporting layer 2; a charge generating layer 3 and a charge transporting layer 4 are provided over the substrate and arranged one over another. Thus, the illustrated structure corresponds to the structure of FIG. 1 with a surface protective layer. Since the outermost surface of the structure of FIG. 1 is a charge generating of a-Si having poor humidity resistance, in the present invention, it is generally desirable that the surface be covered with a protective layer to assure stability toward humidity. With the structures of FIGS. 2 and 3, the charge transporting layer embodying the invention and having high durability provides the outermost surface, so that the surface protective layer need not be provided. However, such photosensitive members can be formed with a surface protective layer so as to be compatible with various other elements within the copying machine, for example, to be free from surface soiling deposition of developer.

Figure 5:
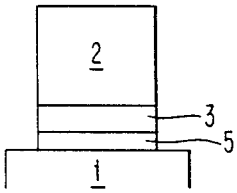

FIG. 5 shows another type comprising an electrically conductive substrate 1, and an intermediate layer 5, a charge generating layer 3 and a charge transporting layer 2 which are formed over the substrate and arranged one over another. Thus, this structure corresponds to the structure of FIG. 2 provided with an intermediate layer. Since a charge generating layer of a-Si is joined to the substrate in the structure of FIG. 2, it is generally desirable to interpose an intermediate layer therebetween to assure good adhesion and an injection inhibitory effect. With the structures of FIGS. 1 and 3, the charge transporting layer of the invention, which has excellent adhesion and injection inhibitory effect, is joined to the substrate, so that no intermediate layer is provided. However, the photosensitive member, of either of these types, can be formed with an intermediate layer in order to render the forming transporting layer compatible with the preceding fabrication step, such as pretreatment of the conductive substrate. Another type of photosensitive member is then available.

Figure 6:
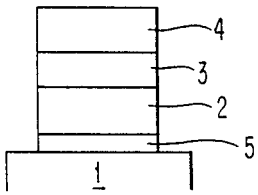

FIG. 6 shows still another type comprising an electrically conductive substrate 1. An intermediate layer 5, a charge transporting layer 2, a charge generating layer 3 and a surface protective layer 4 are formed over the substrate and superposed one over another. Thus, this structure corresponds to the structure of FIG. 1 provided with an intermediate layer and a surface protective layer. The intermediate and protective layers are formed for the same stated reasons. Thus, the provision of these two layers in the structure of FIGS. 2 or 3 affords another type.

According to the present invention, the intermediate layer and the surface protective layer are not limited specifically to any material or fabrication process. Any material or process can be suitably selected so as to provide that the contemplated objects are achieved. The a-C layer of the invention may be used. However, if the material to be used is an insulating material such as one already mentioned, the thickness of the layer needs to be up to 5 microns to preclude occurrence of residual potential.

The charge transporting layer of the photosensitive member embodying the present invention is produced by so-called plasma polymerization wherein molecules in a vapor phase are subjected to discharge decomposition in a vacuum phase. The active neutral seeds or charge seeds contained in plasma atmosphere are brought the substrate by diffusion or an electric or magnetic force and accumulated into a solid phase on the substrate through a rebinding reaction.

Figure 7:
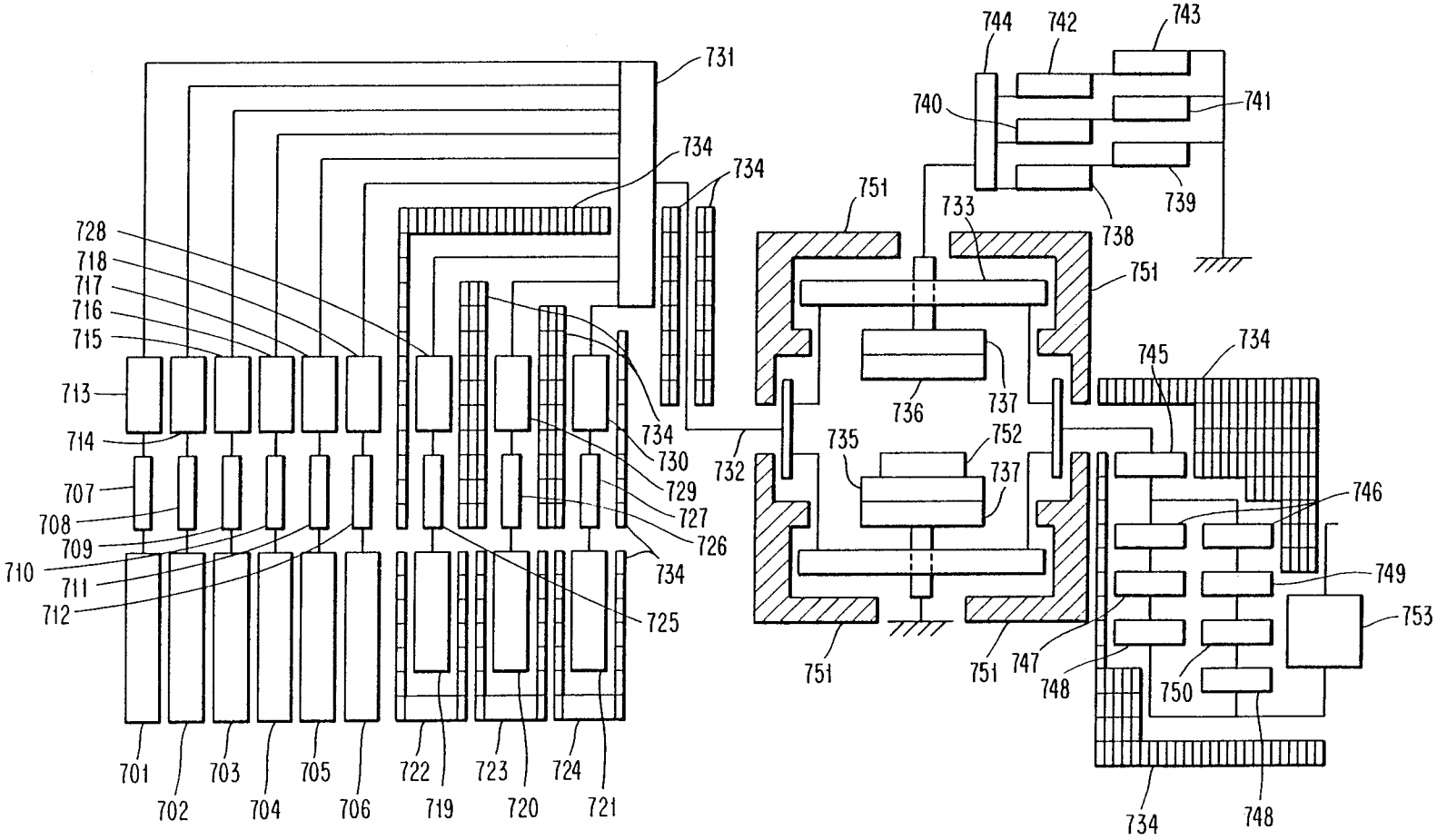
FIG. 7 and 8 are diagrams showing apparatus for preparing photosensitive members of the invention.

FIG. 7 shows an apparatus for preparing the photosensitive member of the invention. First to sixth tanks 701 to 706 have enclosed therein starting material compounds which are in gas phase at room temperature and a carrier gas and are connected respectively to first to sixth regulator valves 707 to 712 and first to sixth flow controllers 713 to 718. First to third containers 719 to 721 contain starting material compounds which are liquid or solid at room temperature, can be preheated by first to third heaters 722 to 724 for vaporizing the compounds, and are connected to seventh to ninth regulator valves 725 to 727 and seventh to ninth flow controllers 728 to 730, respectively. The gases to be used as selected from among these gases are mixed together by a mixer 731 and fed to a reactor 733 via a main pipe 732. The interconnecting piping can be heated by a pipe heater 734 which is suitably disposed so that compounds in a liquid or solid phase at room temperature and vaporized by preheating, will not condense during transport. A grounded electrode 735 and a power application electrode 736 are arranged to oppose each other within the reactor 733. Each of these electrodes can be heated by an electrode heater 737. The power application electrode 736 is connected to a high-frequency power source 739 via a high-frequency power matching device 738, to a low-frequency power source 741 via a low-frequency power matching device 740 and to a d.c. power source 743 via a low-pass filter 742. Power of one of the different frequencies is applicable to the electrode 736 by way of a connection selecting switch 744. The internal pressure of the reactor 733 is adjustable by a pressure control valve 745. The reactor 733 is evacuated by a diffusion pump 747 and an oil rotary pump 748 via an exhaust system selecting valve 746, or by a cooling-removing device 749, a mechanical booster pump 750 and an oil rotary pump 748 via another exhaust system selecting value 746. The exhaust gas is further made harmless by a suitable removal device 753 and then released to the atmosphere. The evacuation piping system can also be heated by a suitably disposed pipe heater 734 so that a material compound which is liquid or solid at room temperature, and vaporized by preheating, will not condense during transport. For the same reason, the reactor 733 can also be heated by a reactor heater 751. An electrically conductive substrate 752 is placed on the electrode 735 in the reactor. Although FIG. 7 shows that the substrate 752 is fixed to the grounded electrode 735, the substrate may be attached to the power application electrode 736, or to both the electrodes.

Figure 8:
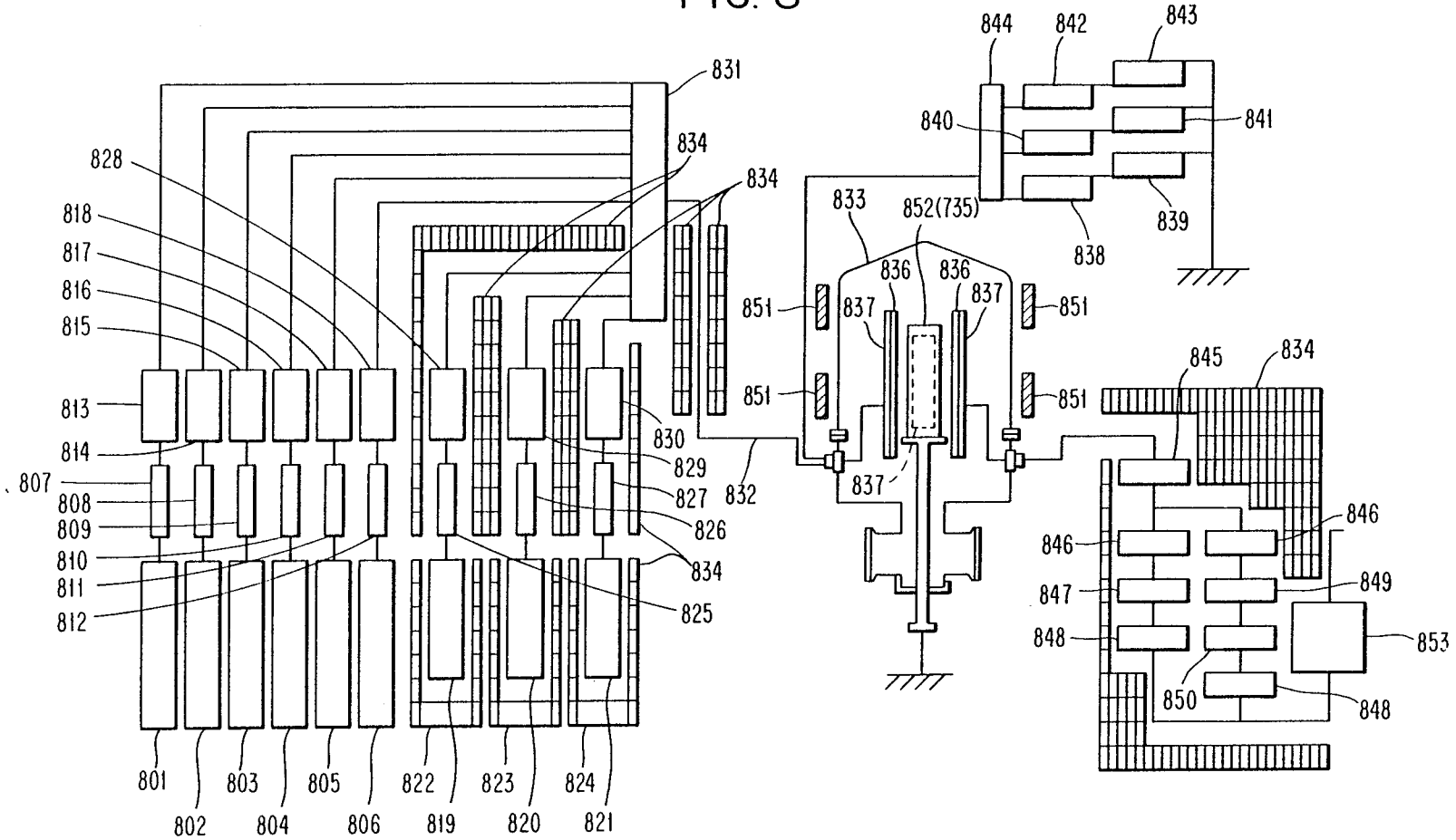

FIG. 8 shows another type of apparatus for preparing the photosensitive member of the invention. This apparatus has the same construction as the apparatus of FIG. 7 with the exception of the interior arrangement of the reactor 833. The numerals shown by 700 order in FIG. 7 are replaced by the numerals at 800 order in FIG. 8. With reference to FIG. 8, the reactor 833 is internally provided with a hollow cylindrical electrically conductive substrate 852 serving also as the grounded electrode 735 of FIG. 7 and with an electrode heater 837 inside thereof. A power application electrode 836, similarly in the form of a hollow cylinder, is provided around the substrate 852 and surrounded by an electrode heater 837. The conductive substrate 852 is rotatable about its own axis by motor from outside.

The reactor for preparing the photosensitive member is first evacuated by the diffusion pump to a vacuum of about $10^{-4}$ to about $10^{-6}$ torr, whereby the adsorbed gas inside the reactor is removed. The reactor is also checked for the degree of vacuum. At the same time, the electrodes and the substrate fixedly placed on the electrode are heated to a predetermined temperature. To obtain a photosensitive member of one of above desired structures, an undercoat layer or a charge generating layer may be formed on the substrate before the charge transporting layer is formed when so required. The undercoat or charge generating layer may be formed by the present apparatus or by some other apparatus. Subsequently, material gases are fed into the reactor from the first to sixth tanks and the first to third containers (i.e. from those concerned), each at a specified flow rate, using the flow controllers concerned, i.e. first to ninth flow controllers and the interior of the reactor is maintained in a predetermined vacuum by the pressure control valve. After the combined flow of gases has become stabilized, the high-frequency power source, for example, is selected by the connection selecting switch to apply a high-frequency power to the power application electrode. This initiates discharge across the two electrodes, forming a solid layer on the substrate with time. The thickness of the layer is controllable by varying the reaction time, such that the discharge is discontinued upon the thickness reaching the desired value.

Any a-Si layer or a-C layer can be formed as desired by using suitably selected material gases. The layers, which have different compositions, can be formed as a laminate structure by temporarily discontinuing the discharge after forming one of the layers, changing the composition of material gases, and then restarting the discharge to form the other layer over the first layer. Further, it is possible to form the different layers in the form of a laminate structrue having a gradient composition by gradually changing the flow rates of material gases with continued discharge. The thickness of each layer is controlled by varying the reaction time. Then, the photosensitive member of the present invention is prepared by discontinuing the discharge when the desired laminate structure is obtained with the thickness of each layer thus controlled.

Next the regulator valves concerned are closed, and the reactor is thoroughly exhausted. When a photosensitive member of the desired structure has been formed according to the invention, the vacuum within the reactor is vitiated and the member is removed from the reactor. If another charge generating layer or overcoat layer are to be superposed on the above structure, such a layer is formed using the present apparatus, as is. The photosensitive member formed by the above process can be taken out of the reaction chamber after destroying the vacuum, and then transferred to another apparatus to form a layer. Thus, the photosensitive member of the present invention can be obtained having a charge transporting layer and a charge generating layer and, if necessary, an overcoat layer.

The present invention will be described with reference to the following examples.

EXAMPLE 1

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL)

The glow discharge decomposition apparatus shown in FIG. 7 was used. First, the interior of the reactor 733 was evacuated to a high vacuum of about $10^{-6}$ torr, and the first, second, third and fourth regulator valves 707, 708, 709 and 710 were thereafter opened to introduce hydrogen gas from the first tank 701 into the first flow controller 713, the acetylene gas from the second tank 702 into the second flow controller 714, the oxygen gas from the third tank 703 into the third flow controller 715 and the tetrafluoromethane from the fourth tank 704 into the fourth flow controller 716 at an output pressure of 1.0 kg/cm$^2$. The dials on the flow controllers were adjusted to supply the hydrogen gas at a flow rate of 180 sccm, the acetylene gas at 40 sccm, the oxygen gas at 4 sccm and the tetrafluoromethane gas at 10 sccm to the reactor 733 through the main pipe 732 via the intermediate mixer 731. After the flows of the gases were stabilized, the internal pressure of the reactor 733 was adjusted to 2.0 torr by the pressure control valve 745. On the other hand, the substrate 752, which was an aluminum substrate measuring 50 mm in length, 50 mm in width and 3 mm in thickness, was preheated to 250° C. With the gas flow rates and the pressure in a stabilized state, 200-watt power with a frequency of 13.56 MHz was applied to the power application electrode 736 from the high-frequency power source 739 preconnected thereto by the selecting switch 744. Plasma polymerization was conducted for 3 hours, forming an a-C layer, 15 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 34 atomic % of hydrogen atoms based on the combined amount of carbon atoms and hydrogen atoms. Further, when subjected to auger electron spectroscopy, the a-C layer thus obtained was found to contain 2.0 atomic % of halogen atoms i.e., fluorine atoms and 1.1 atomic % of oxygen atoms based on all the constituent atoms contained therein.

Charge Generating Layer Forming Step (CGL)

Next, the tanks were partly exchanged and the first, second and sixth regulator valves 707, 708 and 712 were opened to introduce hydrogen gas from the first tank 701 into the first flow controller 713, germane gas from the second tank 702 into the second flow controller 714 and silane gas from the sixth tank 706 into the sixth flow controller 718, each at an output pressure of 1.0 kg/cm$^2$. The dials on the flow controllers were adjusted to supply the hydrogen gas at a flow rate of 200 sccm, germane gas at a flow rate of 0.6 sccm and the silane gas at 100 sccm to the reactor 733. After the flows of the gases stabilized, the internal pressure of the reactor 733 was adjusted to 0.8 torr by the pressure control valve 745. On the other hand, the substrate 752 formed with the a-C layer was preheated to 250° C. With the gas flow rates and the pressure stabilized, 35-watt power with a frequency of 13.56 MHz was applied to the power application electrode 736 from the high-frequency power source 739 to effect glow discharge for 5 minutes, whereby a charge generating a-Si: H layer was formed with a thickness of 0.3 microns.

When subjected to ONH quantitative analysis (EMGA-1300 manufactured by Horiba Seisakusho) and Auger electron spectroscopy, the a-Si layer obtained was found to contain 20 atomic % of hydrogen atoms and 1 atomic % of germanium atoms based on all the constituent atoms therein.

Characteristics

When the photosensitive member obtained was used in the usual Carlson process with negative charging and positive charging, the member showed a maximum charge potential (hereinafter referred to as Vmax) of −610 V (+770 V). (The obtained values at positive charging were shown in parenthesis hereinafter). Specifically, the chargeability per 1 micron (hereinafter referred to as C.A.) was 40 V/micron (50 V/micron) by calculating from the entire thickness of the member, i.e. 15.3 microns, indicating that the member had satisfactory charging properties.

The period of time required for dark decay from Vmax to the potential corresponding to 90% of Vmax (hereinafter referred to as DDR) was about 17 seconds (25 seconds), showing that the member has satisfactory charge retentivity.

The amount of light required for the light decay from Vmax to the potential corresponding to 20% of Vmax with white light (hereinafter referred to as $E\frac{1}{2}$) was about 3.0 lux-sec (4.0 lux-sec), showing that the member was satisfactory in photosensitive characteristics.

These results indicate that the photosensitive member prepared in the present example according to the invention exhibits outstanding performance. When the member was used in the Carlson process for forming images thereon, followed by image transfer, sharp copy images were obtained.

EXAMPLES 2 TO 27

Photosensitive members were prepared in a manner similar to Example 1, each member comprising an electrically conductive substrate (1), a charge transporting layer (2) and a charge generating layer (3) provided in this order as shown in FIG. 1.

Table 1 shows the various condition values for forming a charge transporting layer, Table 2 shows the various condition values for forming a charge generating layer and Table 3 shows the results of the evaluation of each member.

Table 1 and Table 2 show the conditions different from Example 1 used in forming a charge transporting layer and charge generating layer and are classified into 34 items (1) to (34). These items are described at the top column of each Table. Some condition values shown at each item are common to each example, while others vary in each example.

TABLE 1 shows the items (1) to (16) as follows:

(1) flow rate of hydrogen gas from the first tank (701) (sccm)
(2) flow rate of material gas from the second tank (702) (sccm)
(3) flow rate of dopant gas from the third tank (703) (sccm)
(4) flow rate of dopant gas from the fourth tank (704) (sccm)
(5) flow rate of dopant gas from the first container (719) (sccm)
(6) temperature of the first heater (722) (°C.)
(7) pressure (Torr)
(8) temperature of the substrate (°C.)
(9) dimension of the substrate (length × width × thickness) (unit: mm)
(10) frequency from the power source (Hz)
(11) time for plasma polymerization (hour)
(12) thickness of the layer (micron)
(13) power (watt)
(14) hydrogen content (atomic %)
(15) and (16) content of the dopant contained in the charge transporting layer (atomic %)

TABLE 2 shows the items (17) to (34) as follows:

(17) flow rate of hydrogen gas from the first tank (701) (sccm)
(18) flow rate of dopant gas from the second tank (702) (sccm)
(19) flow rate of dopant gas from the third tank (703) (sccm)
(20) flow rate of dopant gas from the fourth tank (704) (sccm)
(21) flow rate of dopant gas from the fifth tank (705) (sccm)
(22) flow rate of dopant gas from the sixth tank (706) (sccm)
(23) pressure (Torr)
(24) temperature of the substrate (°C.)
(25) frequency from the power source (Hz)
(26) time for plasma polymerization (minute)
(27) thickness of the layer (micron)
(28) power (watt)
(29) hydrogen content (atomic %)
(30) to (34) content of the dopant contained in the charge generating layer (atomic %)

The result of the evaluation shown in Table 3 is classified into 7 items (35) to (41) as follows:

(35) initial charging potential (V)
(36) thickness of the entire member (micron)
(37) chargeability per 1 micron (V/micron)
(38) DDR (sec.)
(39) $E(\frac{1}{2})$ (lux-sec.)
(40) light quantity required for light decay to a potential corresponding to 20% of the Vmax potential after the initial charging by using a semiconductive laser having a wavelength of 780 nm (erg/cm$^2$)
(41) clearness of the image The level of the clearness of the image is represented by o (clear) and x (unclear). More specifically, the photosensitive members marked with x are not satisfactory in performance. When such members were used in the Carlson process for forming images thereon, followed by image transfer, fogged copy images only were obtained.

The charge transporting layers of Examples 1 to 27 comprise amorphous carbon containing hydrogen, halogen and oxygen. Table 4 shows the outline of the photosensitive members prepared by Examples 1 to 27.

TABLE 4

| Ex. No. | CTL | CGL |
|---|---|---|
| 1–5 | a-C:H:Hal:O | a-Si:Ge:(H,Hal) |
| 6–10 | " | a-Si:Ge:(H,Hal):(B,P) |

TABLE 4-continued

| Ex. No. | CTL | CGL |
|---|---|---|
| 11, 12, 14 | " | a-Si:Ge:(H,Hal):(B,P):O:N |
| 13, 15 | " | a-Si:Ge:(H,Hal):(B,P):O |
| 16–20 | " | a-Si:Ge:(H,Hal):(B,P):N |
| 21–25 | " | a-Si:Ge:(H,Hal):(B,P):C |

TABLE 4-continued

| Ex. No. | CTL | CGL |
|---|---|---|
| 26 | " | a-Si:Ge:(H,Hal):(B,P):N:C |
| 27 | " | a-Si:Ge:(H.Hal):(B,P):O:C |

From the results shown in Table 3, it is understood that the photosensitive member according to the present invention has improved chargeability and high sensitivity.

TABLE 1

| | Charge Transporting Layer Forming Step | | | | | | | | | | | | | | | | |
|---|---|---|---|---|---|---|---|---|---|---|---|---|---|---|---|---|---|
| Ex No. | (1) (sccm) | (2) (sccm) | (3) (sccm) | (4) (sccm) | (5) (sccm) | (6) (°C.) | (7) (Torr) | (8) (°C.) | (9) (mm) | (10) (Hz) | (11) (Hr) | (12) (μm) | (13) (watt) | (14) (at. %) | (15) (at. %) | | (16) (at. %) |
| 2 | 60 | $C_2H_4$ 60 | $O_2$ 4 | $CCl_4$ 20 | — | — | 2.0 | 230 | 50 × 50 × 3 | 13.56 M | 3.5 | 15 | 200 | 42 | Cl | 4.9 | O 1.0 |
| 3 | 60 | — | $O_2$ 8 | $CF_4$ 30 | $C_8H_8$ 30 | 35 | 2.0 | 180 | 50 × 50 × 3 | 120K | 0.75 | 15 | 200 | 48 | F | 6.1 | O 2.3 |
| 4 | 60 | $C_4H_6$ 60 | $CO_2$ 12 | $CF_4$ 160 | — | — | 1.6 | 120 | 50 × 50 × 3 | 500K | 1.5 | 15 | 130 | 51 | F | 18 | O 2 |
| 5 | 180 | $C_4H_2$ 40 | $O_2$ 4 | $CF_4$ 10 | — | — | 2.0 | 180 | 50 × 50 × 3 | 600K | 0.5 | 15 | 200 | 40 | F | 4.1 | O 1.8 |
| 6 | same as Example 1 | | | | | | | | | | | | | | | | |
| 7 | same as Example 2 | | | | | | | | | | | | | | | | |
| 8 | same as Example 3 | | | | | | | | | | | | | | | | |
| 9 | same as Example 4 | | | | | | | | | | | | | | | | |
| 10 | same as Example 5 | | | | | | | | | | | | | | | | |
| 11 | same as Example 5 | | | | | | | | | | | | | | | | |
| 12 | same as Example 4 | | | | | | | | | | | | | | | | |
| 13 | same as Example 3 | | | | | | | | | | | | | | | | |
| 14 | same as Example 2 | | | | | | | | | | | | | | | | |
| 15 | same as Example 1 | | | | | | | | | | | | | | | | |
| 16 | same as Example 1 | | | | | | | | | | | | | | | | |
| 17 | same as Example 3 | | | | | | | | | | | | | | | | |
| 18 | same as Example 3 | | | | | | | | | | | | | | | | |
| 19 | same as Example 4 | | | | | | | | | | | | | | | | |
| 20 | same as Example 5 | | | | | | | | | | | | | | | | |
| 21 | same as Example 4 | | | | | | | | | | | | | | | | |
| 22 | same as Example 3 | | | | | | | | | | | | | | | | |
| 23 | same as Example 2 | | | | | | | | | | | | | | | | |
| 24 | same as Example 1 | | | | | | | | | | | | | | | | |
| 25 | same as Example 5 | | | | | | | | | | | | | | | | |
| 26 | 200 | $C_4H_6$ 40 | $O_2$ 5 | $CF_4$ 10 | — | — | 1.6 | 140 | 50 × 50 × 3 | 100K | 0.8 | 15 | 130 | 42 | F | 1.9 | O 1.3 |
| 27 | same as Example 26 | | | | | | | | | | | | | | | | |

TABLE 2

Charge Generating Layer Forming Step

| Ex No. | (17) (sccm) | (18) (sccm) | (19) (sccm) | *3 (20) (sccm) | (21) (sccm) | (22) (sccm) | (23) Torr | (24) (°C.) | (25) (Hz) | (26) min. | (27) μm | (28) watt | (29) (at. %) | (30) (at. %) | (31) (at. %) | *1 (32) (at. %) | (33) (at. %) | (34) (at. %) |
|---|---|---|---|---|---|---|---|---|---|---|---|---|---|---|---|---|---|---|
| 2 | 200 | $GeH_4$ 2.0 | — | — | — | $SiH_4$ 100 | 0.8 | 250 | 13.56 M | 5 | 0.3 | 35 | 20 | Ge 3.0 | | | | |
| 3 | 200 | $GeH_4$ 6.0 | — | — | — | $SiH_4$ 100 | 0.9 | 250 | 13.56 M | 5 | 0.3 | 40 | 20 | Ge 10 | | | | |
| 4 | 200 | $GeH_4$ 20 | — | — | — | $SiH_4$ 100 | 1.0 | 250 | 13.56 M | 5 | 0.3 | 45 | 20 | Ge 30 | | | | |
| 5 | 200 | $SiF_4$ 50 | $GeH_4$ 6 | — | — | $SiH_4$ 50 | 0.9 | 230 | 13.56 M | 5 | 0.3 | 35 | 18 | Ge 11 | F 5 | | | |
| 6 | 200 | $GeH_4$ 6 | — | $B_2H_6$ 10 | — | $SiH_4$ 100 | 1.0 | 240 | 13.56 M | 5 | 0.3 | 40 | 18 | Ge 9.7 | | B 10P | | |
| 7 | 200 | $GeH_4$ 6 | — | $PH_3$ 10 | — | $SiH_4$ 100 | 0.8 | 250 | 13.56 M | 5 | 0.3 | 40 | 20 | Ge 10 | | P 11P | | |
| 8 | 200 | $SiF_4$ 50 | $GeH_4$ 6 | $B_2H_6$ 10 | — | $SiH_4$ 50 | 0.9 | 230 | 13.56 M | 5 | 0.3 | 35 | 24 | Ge 10.5 | | B 10P | | F 5 |
| 9 | 200 | $SiF_4$ 50 | $GeH_4$ 6 | $PH_3$ 10 | — | $SiH_4$ 50 | 0.8 | 240 | 13.56 M | 5 | 0.3 | 40 | 26 | Ge 9.8 | | P 13P | | F 5.6 |
| 10 | 200 | $GeH_4$ 6 | — | $B_2H_6$ 10 | — | $SiH_4$ 100 | 1.0 | 240 | 13.56 M | 5 | 0.3 | 40 | 18 | Ge 9.7 | B 10P | | | |
| 11 | 200 | $GeH_4$ 6 | — | $B_2H_6$ 10 | $N_2O$ 0.01 | $SiH_4$ 100 | 0.9 | 230 | 13.56 M | 5 | 0.3 | 45 | 22 | Ge 0.1 | B 10P | O 0.001 | N 0.002 | |
| 12 | 200 | $GeH_4$ 6 | — | $B_2H_6$ 10 | $N_2O$ 3 | $SiH_4$ 100 | 0.8 | 240 | 13.56 M | 5 | 0.3 | 45 | 21 | Ge 0.7 | B 11P | O 0.31 | N 0.60 | |
| 13 | 200 | $GeH_4$ 6 | — | $B_2H_6$ 50 | $O_2$ 5 | $SiH_4$ 100 | 0.8 | 250 | 13.56 M | 5 | 0.3 | 40 | 24 | Ge 11 | B 45P | O 1.0 | | |
| 14 | 200 | $GeH_4$ 10 | $SiF_4$ 50 | $B_2H_6$ 10 | $N_2O$ 1 | $SiH_4$ 50 | 0.9 | 250 | 13.56 M | 5 | 0.3 | 35 | 22 | Ge 17 | B 10P | O 0.1 | N 0.9 | |
| 15 | 200 | $GeH_4$ 3 | — | $PH_3$ 10 | $O_2$ 1.3 | $SiH_4$ 200 | 0.9 | 250 | 13.56 M | 5 | 0.3 | 35 | 18 | Ge 4.2 | P 11P | O 0.3 | | |
| 16 | 200 | $GeH_4$ 6 | — | $B_2H_6$ 10 | $N_2$ 0.01 | $SiH_4$ 100 | 0.8 | 250 | 13.56 M | 5 | 0.3 | 35 | 23 | Ge 11 | B 10P | N 0.001 | | |
| 17 | 180 | $GeH_4$ 8 | — | $B_2H_6$ 10 | $NH_3$ 2 | $SiH_4$ 100 | 0.9 | 240 | 13.56 M | 5 | 0.3 | 45 | 21 | Ge 13.2 | B 11P | N 0.3 | | |
| 18 | 200 | $GeH_4$ 10 | — | $B_2H_6$ 50 | $N_2$ 10 | $SiH_4$ 100 | 0.8 | 250 | 13.56 M | 5 | 0.3 | 40 | 24 | Ge 15.8 | B 45P | N 1.0 | | |
| 19 | 200 | $GeH_4$ 6 | $SiF_4$ 50 | $B_2H_6$ 100 | $N_2$ 1 | $SiH_4$ 50 | 0.9 | 250 | 13.56 M | 5 | 0.3 | 35 | 22 | Ge 10.3 | B 95P | N 0.1 | | |
| 20 | 200 | $GeH_4$ 6 | — | $PH_3$ 10 | $N_2$ 3 | $SiH_4$ 200 | 1.0 | 250 | 13.56 M | 5 | 0.3 | 35 | 18 | Ge 10.0 | P 12P | N 0.3 | | |
| 21 | 200 | $GeH_4$ 10 | — | $B_2H_6$ 10 | $C_2H_6$ 3 | $SiH_4$ 100 | 0.9 | 240 | 13.56 M | 5 | 0.3 | 45 | 21 | Ge 15.7 | B 11P | C 0.3 | | |
| 22 | 200 | $GeH_4$ 6 | — | $B_2H_6$ 10 | $CH_4$ 0.01 | $SiH_4$ 100 | 0.8 | 250 | 13.56 M | 5 | 0.3 | 35 | 20 | Ge 9.8 | B 9P | C 0.001 | | |
| 23 | 200 | $GeH_4$ 6 | — | $B_2H_6$ 100 | $CH_4$ 10 | $SiH_4$ 100 | 0.8 | 250 | 13.56 M | 5 | 0.3 | 40 | 24 | Ge 10.5 | B 95P | C 1.0 | | |
| 24 | 200 | $GeH_4$ 3 | $SiF_4$ 50 | $B_2H_6$ 10 | $CF_4$ 0.1 | $SiH_4$ 50 | 0.9 | 250 | 13.56 M | 5 | 0.3 | 35 | 22 | Ge 6.4 | B 11P | C 0.1 | | F 4.8 |
| 25 | 200 | $GeH_4$ 6 | — | $PH_3$ 10 | $CH_4$ 3 | $SiH_4$ 200 | 1.0 | 230 | 13.56 M | 5 | 0.3 | 35 | 18 | Ge 10.4 | P 12P | C 0.3 | | |
| 26 | 200 | $GeH_4$ | $SiF_4$ | $B_2H_6$ | $C_2H_4$ | *2 | 0.9 | 240 | 13.56 | 5 | 0.3 | 40 | 21.0 | Ge | B | C 0.3 | N 0.2 | F 5.1 |

TABLE 2-continued

| Ex No. | (17) (sccm) | (18) (sccm) | (19) (sccm) | *3 (20) (sccm) | (21) (sccm) | (22) (sccm) | (23) Torr | Charge Generating Layer Forming Step (24) (°C.) | (25) (Hz) | (26) min. | (27) μm | (28) watt | (29) (at. %) | (30) (at. %) | (31) (at. %) | *1 (32) (at. %) | (33) (at. %) | (34) (at. %) |
|---|---|---|---|---|---|---|---|---|---|---|---|---|---|---|---|---|---|---|
| | | 2 | 50 | 10 | 3 | Si $N_2$ $H_4$ 2 50 | | | M | | | | | 2.4 | 9.2P | | | |
| 27 | 200 | $GeH_4$ 6 | $SiF_4$ 50 | $PH_3$ 10 | $C_2H_4$ 2 | *2 Si $O_2$ $H_4$ 3 50 | 1.0 | 240 | 13.56 M | 5.2 | 0.3 | 40 | 21.2 | Ge 2.8 | P 9.4P | C 0.2 | O 0.3 | F 4.8 |

*1 The unit P means atomic ppm.
*2 The seventh tank was added to the apparatus to introduce the seventh gas.
*3 $B_2H_6$ and $PH_3$ at this column are diluted to the concentration of 100 ppm with hydrogen gas.

TABLE 3

| Ex. No. | (35) (V) − | (35) (V) + | (36) (μm) | (37) (V/μm) − | (37) (V/μm) + | (38) (sec.) − | (38) (sec.) + | (39) ($E_{\frac{1}{2}}$) − | (39) ($E_{\frac{1}{2}}$) + | (40) (erg/cm²) − | (40) (erg/cm²) + | (41) |
|---|---|---|---|---|---|---|---|---|---|---|---|---|
| | Result of Evaluation | | | | | | | | | | | |
| 2 | 480 | 610 | 15.3 | 32 | 40 | 12 | 15 | 1.2 | 1.6 | 7.8 | 9.4 | |
| 3 | 460 | 560 | 15.3 | 30 | 36 | 11 | 14 | 1.1 | 1.5 | 7.0 | 9.1 | |
| 4 | 200 | 210 | 15.3 | 13 | 14 | 3.0 | 2.5 | 5.2 | 4.4 | — | — | |
| 5 | 500 | 640 | 15.3 | 33 | 42 | 13 | 16 | 2.7 | 3.6 | — | — | |
| 6 | 590 | 580 | 15.3 | 39 | 38 | 19 | 20 | 3.1 | 2.9 | — | — | |
| 7 | 390 | 610 | 15.3 | 26 | 40 | 10 | 15 | 1.1 | 2.3 | — | — | |
| 8 | 590 | 590 | 15.3 | 39 | 39 | 14 | 13 | 1.5 | 1.4 | 9.8 | 8.0 | |
| 9 | 250 | 340 | 15.3 | 16 | 22 | 5 | 5 | 3.4 | 5.7 | — | — | |
| 10 | 520 | 490 | 15.3 | 33 | 32 | 13 | 12 | 2.6 | 1.2 | — | — | |
| 11 | 540 | 540 | 15.3 | 35 | 35 | 13 | 14 | 2.7 | 2.5 | — | — | |
| 12 | 330 | 320 | 15.3 | 21 | 20 | 5 | 4 | 4.3 | 4.0 | — | — | |
| 13 | 730 | 670 | 15.3 | 47 | 44 | 17 | 16 | 3.0 | 1.8 | — | — | |
| 14 | 500 | 530 | 15.3 | 32 | 35 | 13 | 14 | 1.5 | 1.4 | 8.1 | 9.8 | |
| 15 | 580 | 830 | 15.3 | 38 | 54 | 19 | 29 | 2.7 | 6.9 | — | — | |
| 16 | 610 | 580 | 15.3 | 40 | 38 | 20 | 19 | 3.1 | 2.9 | — | — | |
| 17 | 610 | 580 | 15.3 | 40 | 38 | 14 | 13 | 2.3 | 1.2 | — | — | |
| 18 | 660 | 680 | 15.3 | 43 | 44 | 15 | 17 | 1.8 | 1.2 | 10.0 | 7.3 | |
| 19 | 330 | 340 | 15.3 | 21 | 22 | 4 | 4 | 4.3 | 3.1 | — | — | |
| 20 | 500 | 770 | 15.3 | 33 | 50 | 12 | 19 | 2.1 | 6.9 | — | — | |
| 21 | 310 | 280 | 15.3 | 20 | 18 | 5 | 4 | 3.7 | 3.2 | — | — | |
| 22 | 530 | 560 | 15.3 | 35 | 37 | 13 | 14 | 1.4 | 1.3 | 8.3 | 7.2 | |
| 23 | 670 | 660 | 15.3 | 44 | 43 | 17 | 14 | 3.0 | 1.8 | — | — | |
| 24 | 720 | 770 | 15.3 | 47 | 50 | 19 | 21 | 3.8 | 3.6 | — | — | |
| 25 | 500 | 760 | 15.3 | 33 | 49 | 13 | 19 | 2.1 | 6.9 | — | — | |
| 26 | 580 | 620 | 15.3 | 38 | 40.5 | 13 | 14.2 | 1.8 | 2.3 | — | — | |
| 27 | 580 | 570 | 15.3 | 37.9 | 37.3 | 15.3 | 15.0 | 2.4 | 1.8 | — | — | |

EXAMPLES 28 TO 49

Photosensitive members were prepared, the members comprising an electrically conductive substrate (1), a charge transporting layer (2) and a charge generating layer (3) provided in this order as shown in FIG. 1.

The respective condition values for forming a charge transporting layer and a charge generating layer are shown in Table 5 and Table 6. Table 7 indicates the results of the evaluation of each member.

The items shown in Tables 5, 6 and 7 are respectively the same as those in Tables 1, 2 and 3.

The charge transporting layers of Examples 28 to 49 comprise amorphous carbon containing hydrogen, halogen and nitrogen. Table 8 shows the outline of the photosensitive members prepared by Examples 28 to 49.

TABLE 8

| Ex. No. | CTL | CGL |
|---|---|---|
| 28–31 | a-C:H:Hal:N | a-Si:Ge:(H,Hal) |
| 32–35 | " | a-Si:Ge:(H,Hal):(B,P) |
| 36 | " | a-Si:Ge:(H,Hal):(B,P):O:N |
| 37–39 | " | a-Si:Ge:(H,Hal):(B,P):O |
| 40–43 | " | a-Si:Ge:(H,Hal):(B,P):N |
| 44–47 | " | a-Si:Ge:(H,Hal):(B,P):C |
| 48 | " | a-Si:Ge:(H,Hal):(B,P):N:C |
| 49 | " | a-Si:Ge:(H.Hal):(B,P):O:C |

From the results shown in Table 7, it is understood that the photosensitive member according to the present invention has improved chargeability and high sensitivity.

TABLE 5

| Ex. No. | (1) (sccm) | (2) (sccm) | (3) (sccm) | (4) (sccm) | (5) (sccm) | (6) (°C.) | (7) (Torr) | (8) (°C.) | (9) (mm) | (10) (Hz) | (11) (Hr) | (12) (μm) | (13) (Watt) | (14) (at. %) | (15) (at. %) | | (16) (at. %) | |
|---|---|---|---|---|---|---|---|---|---|---|---|---|---|---|---|---|---|---|
| | Charge Transporting Layer Forming Step | | | | | | | | | | | | | | | | | |
| 28 | 190 | $C_2H_2$ 45 | $N_2$ 7 | $CF_4$ 10 | — | — | 2.0 | 200 | 50 × 50 × 3 | 13.56 M | 2.6 | 15 | 200 | 34 | F | 2.0 | N | 0.8 |
| 29 | 60 | — | $N_2$8 | $CF_4$ 30 | $C_8H_8$ 30 | 35 | 2.0 | 180 | 50 × 50 × 3 | 170K | 0.8 | 15 | 200 | 47 | F | 6.1 | N | 2.1 |
| 30 | 180 | $C_4H_2$ 40 | $N_2$7 | $CF_4$ 10 | — | — | 2.0 | 180 | 50 × 50 × 3 | 500K | 0.5 | 15 | 200 | 40 | F | 4.1 | N | 0.7 |
| 31 | 120 | $C_4H_6$ 60 | $NH_3$ 6 | $CF_4$ 160 | — | — | 2.1 | 120 | 50 × 50 × 3 | 400K | 1.3 | 15 | 140 | 51 | F | 17.0 | N | 2.4 |
| 32 | same as Example 28 | | | | | | | | | | | | | | | | | |
| 33 | same as Example 29 | | | | | | | | | | | | | | | | | |
| 34 | same as Example 31 | | | | | | | | | | | | | | | | | |
| 35 | 180 | $C_4H_2$ 40 | $N_2$ 12 | $CF_4$ 10 | — | — | 2.0 | 180 | 50 × 50 × 3 | 500K | 0.5 | 15 | 200 | 40 | F | 4.1 | N | 1.8 |
| 36 | same as Example 30 | | | | | | | | | | | | | | | | | |
| 37 | same as Example 31 | | | | | | | | | | | | | | | | | |
| 38 | same as Example 29 | | | | | | | | | | | | | | | | | |
| 39 | 190 | $C_2H_2$ 45 | $N_2$ 8 | $CF_4$ 10 | — | — | 2.0 | 200 | 50 × 50 × | 13.56 M | 2.6 | 15 | 200 | 34 | F | 2.0 | N | 1.1 |

TABLE 5-continued

| Ex. No. | (1) (sccm) | (2) (sccm) | (3) (sccm) | (4) (sccm) | (5) (sccm) | (6) (°C.) | Charge Transporting Layer Forming Step (7) (Torr) | (8) (°C.) | (9) (mm) | (10) (Hz) | (11) (Hr) | (12) (μm) | (13) (Watt) | (14) (at. %) | (15) (at. %) | | (16) (at. %) |
|---|---|---|---|---|---|---|---|---|---|---|---|---|---|---|---|---|---|
| | | | | | | | | | 3 | | | | | | | | |
| 40 | | | | | | | same as Example 39 | | | | | | | | | | |
| 41 | | | | | | | same as Example 29 | | | | | | | | | | |
| 42 | | | | | | | same as Example 31 | | | | | | | | | | |
| 43 | | | | | | | same as Example 30 | | | | | | | | | | |
| 44 | | | | | | | same as Example 29 | | | | | | | | | | |
| 45 | | | | | | | same as Example 28 | | | | | | | | | | |
| 46 | | | | | | | same as Example 31 | | | | | | | | | | |
| 47 | | | | | | | same as Example 30 | | | | | | | | | | |
| 48 | 200 | $C_4H_6$ 40 | $N_2$ 5 | $CCl_4$ 10 | — | — | 1.7 | 140 | 50 × 50 × 3 | 100K | 0.8 | 15 | 140 | 41.5 | Cl | 1.8 | N 1.4 |
| 49 | | | | | | | same as Example 48 | | | | | | | | | | |

TABLE 6

| Ex. No. | (17) (sccm) | (18) (sccm) | (19) (sccm) | (20) (sccm) | (21) (sccm) | (22) (sccm) | Charge Generating Layer Forming Step (23) Torr | (24) (°C.) | (25) (Hz) | (26) min. | (27) μm | (28) watt | (29) (at. %) | (30) (at. %) | (31) (at. %) | (32) (at. %) | (33) (at. %) | (34) (at. %) |
|---|---|---|---|---|---|---|---|---|---|---|---|---|---|---|---|---|---|---|
| 28 | | | | | | | same as Example 5 | | | | | | | | | | | |
| 29 | | | | | | | same as Example 2 | | | | | | | | | | | |
| 30 | | | | | | | same as Example 4 | | | | | | | | | | | |
| 31 | | | | | | | same as Example 3 | | | | | | | | | | | |
| 32 | | | | | | | same as Example 6 | | | | | | | | | | | |
| 33 | | | | | | | same as Example 8 | | | | | | | | | | | |
| 34 | | | | | | | same as Example 9 | | | | | | | | | | | |
| 35 | | | | | | | same as Example 8 | | | | | | | | | | | |
| 36 | | | | | | | same as Example 15 | | | | | | | | | | | |
| 37 | | | | | | | same as Example 11 | | | | | | | | | | | |
| 38 | | | | | | | same as Example 12 | | | | | | | | | | | |
| 39 | | | | | | | same as Example 14 | | | | | | | | | | | |
| 40 | | | | | | | same as Example 20 | | | | | | | | | | | |
| 41 | | | | | | | same as Example 17 | | | | | | | | | | | |
| 42 | | | | | | | same as Example 18 | | | | | | | | | | | |
| 43 | | | | | | | same as Example 19 | | | | | | | | | | | |
| 44 | | | | | | | same as Example 23 | | | | | | | | | | | |
| 45 | | | | | | | same as Example 22 | | | | | | | | | | | |
| 46 | | | | | | | same as Example 24 | | | | | | | | | | | |
| 47 | | | | | | | same as Example 25 | | | | | | | | | | | |
| 48 | | | | | | | same as Example 26 | | | | | | | | | | | |
| 49 | | | | | | | same as Example 27 | | | | | | | | | | | |

TABLE 7

| Ex. No. | (35) (V) − | (35) (V) + | (36) (μm) | Result of Evaluation (37) (V/μm) − | (37) (V/μm) + | (38) (sec.) − | (38) (sec.) + | (39) ($E_{\frac{1}{2}}$) − | (39) ($E_{\frac{1}{2}}$) + | (40) (erg/cm²) − | (40) (erg/cm²) + | (41) |
|---|---|---|---|---|---|---|---|---|---|---|---|---|
| 28 | 580 | 720 | 15.3 | 38 | 48 | 19 | 24 | 3.2 | 4.3 | — | — | |
| 29 | 510 | 610 | 15.3 | 33 | 40 | 13 | 15 | 1.2 | 1.6 | 7.6 | 9.5 | |
| 30 | 380 | 430 | 15.3 | 25 | 28 | 10 | 11 | 3.4 | 3.9 | — | — | |
| 31 | 230 | 280 | 15.3 | 15 | 18 | 4 | 5 | 3.3 | 3.1 | — | — | |
| 32 | 590 | 570 | 15.3 | 39 | 38 | 20 | 19 | 3.1 | 2.9 | — | — | |
| 33 | 570 | 580 | 15.3 | 37 | 38 | 14 | 16 | 1.6 | 1.5 | 9.2 | 8.4 | |
| 34 | 250 | 330 | 15.3 | 16 | 22 | 5 | 7 | 3.5 | 5.6 | — | — | |
| 35 | 570 | 590 | 15.3 | 37 | 38 | 14 | 15 | 2.7 | 2.6 | — | — | |
| 36 | 500 | 720 | 15.3 | 33 | 47 | 13 | 19 | 2.1 | 6.0 | — | — | |
| 37 | 280 | 260 | 15.3 | 18 | 17 | 4 | 4 | 3.7 | 2.7 | — | — | |
| 38 | 640 | 650 | 15.3 | 42 | 42 | 16 | 19 | 2.0 | 1.5 | 13.2 | 8.1 | |
| 39 | 590 | 670 | 15.3 | 39 | 37 | 20 | 17 | 3.7 | 3.6 | — | — | |
| 40 | 580 | 860 | 15.3 | 38 | 56 | 31 | 29 | 2.5 | 8.2 | — | — | |
| 41 | 600 | 600 | 15.3 | 39 | 39 | 37 | 38 | 1.5 | 1.4 | 8.6 | 9.8 | |
| 42 | 330 | 310 | 15.3 | 22 | 20 | 5 | 4 | 3.7 | 3.4 | — | — | |
| 43 | 630 | 700 | 15.3 | 41 | 46 | 13 | 12 | 2.8 | 2.6 | — | — | |
| 44 | 700 | 660 | 15.3 | 46 | 43 | 17 | 16 | 1.8 | 2.9 | — | — | |
| 45 | 580 | 660 | 15.3 | 38 | 43 | 19 | 20 | 3.1 | 2.8 | — | — | |
| 46 | 330 | 340 | 15.3 | 22 | 22 | 5 | 4 | 4.4 | 3.3 | — | — | |
| 47 | 500 | 760 | 15.3 | 33 | 49 | 13 | 19 | 1.9 | 6.5 | — | — | |
| 48 | 590 | 650 | 15.3 | 38.6 | 42.5 | 14.5 | 15.6 | 2.0 | 2.4 | — | — | |
| 49 | 610 | 600 | 15.3 | 39.9 | 39.2 | 14.2 | 14.0 | 2.6 | 1.7 | — | — | |

EXAMPLES 50 TO 56

Photosensitive members were prepared as similarly as with Example 1, each member comprising an electrically conductive substrate (1), a charge transporting layer (2) and a charge generating layer (3) provided in this order as shown in FIG. 1.

Table 9 shows the various condition values for forming a charge transporting layer, Table 10 shows the various condition values for forming a charge generating layer and Talbe 11 shows the results of the evaluation of each member.

The items shown in Tables 9, 10 and 11 are respectively the same as those in Tables 1, 2 and 3.

The charge transporting layers of Examples 50 to 56 comprise amorphous carbon containing hydrogen, halogen, oxygen and nitrogen. Table 12 shows the outline of the photosensitive members prepared by Examples 50 to 56.

TABLE 12

| Ex. No. | CTL | CGL |
|---|---|---|
| 50 | a-C:H:O:N | a-Si:Ge:(H,Hal) |
| 51 | " | a-Si:Ge:(H,Hal):(B,P) |
| 52 | " | a-Si:Ge:(H,Hal):(B,P):O:N |
| 53 | " | a-Si:Ge:(H,Hal):(B,P):N |
| 54 | " | a-Si:Ge:(H,Hal):(B,P):C |
| 55 | " | a-Si:Ge:(H,Hal):(B,P):C:N |
| 56 | " | a-Si:Ge:(H,Hal):(B,P):C:O |

From the results shown in Table 11, it is understood that the photosensitive member according to the present invention has improved chargeability and high sensitivity.

TABLE 9

| | Charge Transporting Layer Forming Step | | | | | | | | | | | | | | | | | | |
|---|---|---|---|---|---|---|---|---|---|---|---|---|---|---|---|---|---|---|---|
| Ex No. | (1) (sc cm) | (2) (sc cm) | (3) (sccm) | (4) (sccm) | (5) (sccm) | (6) (°C.) | (7) (Torr) | (8) (°C.) | (9) (mm) | (10) (Hz) | (11) (Hr) | (12) (μm) | (13) (watt) | (14) (at. %) | (15) (at. %) | (16) (at. %) | | (16') | |
| 50 | 60 | $C_2H_4$ 60 | $N_2O$ 16 | $CCl_4$ 20 | — | — | 2.0 | 240 | 50 × 50 × 3 | 13.56 M | 3.25 | 15 | 200 | 43 | Cl 5.0 | N | 1.0 | 0 | 0.5 |
| 51 | same as Example 50 | | | | | | | | | | | | | | | | | | |
| 52 | same as Example 50 | | | | | | | | | | | | | | | | | | |
| 53 | same as Example 50 | | | | | | | | | | | | | | | | | | |
| 54 | same as Example 50 | | | | | | | | | | | | | | | | | | |
| 55 | 200 | $C_4H_2$ 45 | $CF_4$ 10 | $O_2$ 5 | * $N_2$ 5 | — | 1.2 | 130 | 50 × 50 × 3 | 500K | 1.16 | 15 | 160 | 38.2 | F 1.5 | N | 1.0 | 0 | 1.1 |
| 56 | same as Example 55 | | | | | | | | | | | | | | | | | | |

*This gas was introduced from the sixth tank.

TABLE 10

| | Charge Generating Layer Forming Step | | | | | | | | | | | | | | | | | |
|---|---|---|---|---|---|---|---|---|---|---|---|---|---|---|---|---|---|---|
| Ex. No. | (17) (sccm) | (18) (sccm) | (19) (sccm) | (20) (sccm) | (21) (sccm) | (22) (sccm) | (23) Torr | (24) (°C.) | (25) (Hz) | (26) min. | (27) μm | (28) watt | (29) (at. %) | (30) (at. %) | (31) (at. %) | (32) (at. %) | (33) (at. %) | (34) (at. %) |
| 50 | same as Example 1 | | | | | | | | | | | | | | | | | |
| 51 | same as Example 7 | | | | | | | | | | | | | | | | | |
| 52 | same as Example 13 | | | | | | | | | | | | | | | | | |
| 53 | same as Example 16 | | | | | | | | | | | | | | | | | |
| 54 | same as Example 21 | | | | | | | | | | | | | | | | | |
| 55 | same as Example 26 | | | | | | | | | | | | | | | | | |
| 56 | same as Example 27 | | | | | | | | | | | | | | | | | |

TABLE 11

| | Result of Evaluation | | | | | | | | | | | |
|---|---|---|---|---|---|---|---|---|---|---|---|---|
| | (35) (V) | | (36) | (37) (V/μm) | | (38) (sec.) | | (39) ($E_{\frac{1}{2}}$) | | (40) (erg/cm²) | | |
| Ex. No. | − | + | (μm) | − | + | − | + | − | + | − | + | (41) |
| 50 | 520 | 640 | 15.3 | 34 | 42 | 13 | 16 | 1.3 | 1.7 | 8.3 | 12.2 | |
| 51 | 390 | 610 | 15.3 | 26 | 40 | 9 | 15 | 1.1 | 2.3 | 6.5 | 14.2 | |
| 52 | 670 | 610 | 15.3 | 44 | 40 | 17 | 15 | 3.0 | 1.8 | — | — | |
| 53 | 520 | 480 | 15.3 | 34 | 32 | 13 | 14 | 1.3 | 1.2 | 7.8 | 7.5 | |
| 54 | 570 | 570 | 15.3 | 37 | 37 | 14 | 13 | 1.5 | 1.3 | 9.6 | 7.5 | |
| 55 | 600 | 630 | 15.3 | 39.2 | 41.2 | 13 | 13.8 | 1.5 | 2.4 | — | — | |
| 56 | 620 | 590 | 15.3 | 40.5 | 38.6 | 12.9 | 12.3 | 2.7 | 1.9 | — | — | |

COMPARATIVE EXAMPLES 1 TO 9

Photosensitive members were prepared, the members comprising an electrically conductive substrate (1), a charge transporting layer (2) and a charge generating layer (3) provided in this order as shown in FIG. 1.

The respective condition values for forming a charge transporting layer and a charge generating layer are shown in Table 13 and Table 14. Table 15 indicates the results of the evaluation of each member.

The items shown in Tables 13, 14 and 15 are respectively the same as those in Tables 1, 2 and 3.

As apparent from Table 15, the comparative photosensitive members are not satisfactory in electrophotographic performance.

TABLE 13

| Com. Ex. No. | (1) (sccm) | (2) (sccm) | (3) (sccm) | (4) (sccm) | (5) (sccm) | (6) (°C.) | (7) (Torr) | (8) (°C.) | (9) (mm) | (10) (Hz) | (11) (Hr) | (12) (μm) | (13) (watt) | (14) (at. %) | (15) (at. %) | | (16) (at. %) | |
|---|---|---|---|---|---|---|---|---|---|---|---|---|---|---|---|---|---|---|
| | Charge Transporting Layer Forming Step | | | | | | | | | | | | | | | | | |
| 1 | 200 | $C_2H_2$ 45 | $CF_4$ 10 | $O_2$ 31 | — | — | 1.7 | 200 | 50 × 50 × 3 | 13.56 M | 3.5 | 15 | 200 | 29.8 | O | 7.2 | F | 1.9 |
| 2 | 200 | $C_2H_2$ 45 | $CF_4$ 10 | $N_2$ 42 | — | — | 1.5 | 180 | 50 × 50 × 3 | 13.56 M | 3.16 | 15 | 220 | 30.2 | N | 5.5 | F | 1.7 |
| 3 | same as Example 1 | | | | | | | | | | | | | | | | | |
| 4 | same as Example 1 | | | | | | | | | | | | | | | | | |
| 5 | same as Example 11 | | | | | | | | | | | | | | | | | |
| 6 | same as Example 40 | | | | | | | | | | | | | | | | | |
| 7 | same as Example 21 | | | | | | | | | | | | | | | | | |
| 8 | same as Example 6 | | | | | | | | | | | | | | | | | |
| 9 | same as Example 32 | | | | | | | | | | | | | | | | | |

TABLE 14

| Com. Ex No | (17) (sc cm) | (18) (sc cm) | *3 (19) (sc cm) | (20) (sc cm) | (21) (sc cm) | (22) (sc cm) | (23) Torr | (24) (°C.) | (25) (Hz) | (26) min. | (27) μm | (28) watt | (29) (at. %) | (30) (at. %) | (31) (at. %) | | *1 (32) (at. %) | | (33) (at. %) | (34) (at. %) |
|---|---|---|---|---|---|---|---|---|---|---|---|---|---|---|---|---|---|---|---|---|
| | Charge Generating Layer Forming Step | | | | | | | | | | | | | | | | | | | |
| 1 | same as Example 1 | | | | | | | | | | | | | | | | | | | |
| 2 | same as Example 28 | | | | | | | | | | | | | | | | | | | |
| 3 | 200 | $GeH_4$ 37 | — | — | — | $SiH_4$ 50 | 0.85 | 250 | 13.56 M | 5.4 | 0.3 | 35 | 10 | Ge 30.9 | | | | | | |
| 4 | 200 | — | — | — | — | $SiH_4$ 100 | 0.85 | 250 | 13.56 M | 5.3 | 0.3 | 40 | 24 | | | | | | | |
| 5 | 200 | $GeH_4$ 7 | $B_2H_6$ 10 | $N_2O$ 11 | — | $SiH_4$ 100 | 0.85 | 250 | 13.56 M | 5.4 | 0.3 | 40 | 18 | Ge 9.8 | 0 | 1.1 | B | 10P | | |
| 6 | 200 | $GeH_4$ 7 | $PH_3$ 11 | $N_2$ 35 | — | $SiH_4$ 100 | 0.85 | 245 | 13.56 M | 5.2 | 0.3 | 35 | 18.5 | Ge 9.9 | N | 3.4 | P | 9.5P | | |
| 7 | 200 | $GeH_4$ 7 | $B_2H_6$ 11 | $C_2H_6$ 54 | — | $SiH_4$ 100 | 0.85 | 245 | 13.56 M | 5.1 | 0.3 | 40 | 20.1 | Ge 10 | C | 5.2 | B | 10P | | |
| 8 | 200 | $GeH_4$ 6 | *4 10% $B_2H_6$ 25 | — | — | $SiH_4$ 100 | 0.9 | 245 | 13.56 M | 5.2 | 0.3 | 35 | 18.2 | Ge 9.8 | B | 2.6 | | | | |
| 9 | 200 | $GeH_4$ 6 | *5 10% $PH_3$ 30 | — | — | $SiH_4$ 100 | 0.9 | 245 | 13.56 M | 5.3 | 0.3 | 36 | 17.5 | Ge 9.8 | P | 2.7 | | | | |

*1 Same as Table 2
*3 Same as Table 2
*4 10% $B_2H_6$ means the diborane gas diluted to the concentration of 10% with hydrogen gas.
*5 10% $PH_3$ means the phosphine gas diluted to the concentration of 10% with hydrogen gas.

TABLE 15

| Com. Ex. No. | (35) (V) − | (35) (V) + | (36) (μm) | (37) (V/μm) − | (37) (V/μm) + | (38) (sec.) − | (38) (sec.) + | (39) (E ½) − | (39) (E ½) + | (40) (erg/cm²) − | (40) (erg/cm²) + | (41) |
|---|---|---|---|---|---|---|---|---|---|---|---|---|
| | Result of Evaluation | | | | | | | | | | | |
| 1 | 1000 | 1010 | 15.3 | 65.4 | 66.0 | 65 | 71 | 22.0 | 23.0 | — | — | X |
| 2 | 990 | 995 | 15.3 | 64.7 | 65.0 | 64 | 70 | 21.5 | 24.0 | — | — | X |
| 3 | 166 | 194 | 15.3 | 10.8 | 12.7 | 63 | 72 | 23.0 | 24.5 | — | — | X |
| 4 | 520 | 540 | 15.3 | 34.0 | 35.3 | 5.9 | 7.0 | 2.4 | 2.7 | — | — | X |
| 5 | 990 | 995 | 15.3 | 64.7 | 65.0 | 60 | 65 | 23.0 | 24.9 | — | — | X |
| 6 | 980 | 1050 | 15.3 | 64.0 | 68.9 | 59 | 70 | 23.5 | 24.7 | — | — | X |
| 7 | 990 | 1100 | 15.3 | 64.7 | 71.9 | 60 | 69 | 24.5 | 26.5 | — | — | X |
| 8 | 170 | 220 | 15.3 | 11.1 | 14.4 | 0.2 | 0.3 | 17.2 | 18.1 | — | — | X |
| 9 | 180 | 175 | 15.3 | 11.8 | 11.4 | 0.3 | 0.2 | 23.0 | 22.4 | — | — | X |

What is claimed is:

1. A photosensitive member comprising:

an electrically conductive substrate;

a charge generating layer comprising amorphous silicon as a matrix containing germanium atoms in an amount of up to about 30 atomic % based on the combined amount of silicon atoms and germanium atoms and at least one of hydrogen and halogen atoms in an amount of about 10 to about 35 atomic % based on the combined amount of silicon atoms and hydrogen atoms or of silicon atoms and halogen atoms, said charge generating layer having a thickness of about 0.1 to about 5 microns; and a charge transporting layer comprising amorphous carbon containing hydrogen in an amount of about 30 to about 60 atomic % based on the combined amount of hydrogen atoms and carbon atoms, said charge transporting layer having a thickness of about 5 to about 50 microns and containing at least one of halogen atoms in an amount of about 0.1 to about 25 atomic %, oxygen atoms in an amount of about 0.01 to about 7.0 atomic % and nitrogen atoms in an amount of about 0.01 to about 5.0 atomic % based on all the constituent atoms therein.

2. A photosensitive member as claimed in claim 1 wherein said charge generating layer further comprises boron atoms or phosphorus atoms in an effective amount of less than about 20,000 atomic ppm based on all the constituent atoms therein.

3. A photosensitive member as claimed in claim 2 wherein the effective amount of the boron or phosphorus atoms is up to about 150 atomic ppm based on all the constituent atoms therein.

4. A photosensitive member as claimed in claim 1 wherein the charge generating layer further comprises oxygen atoms in an amount of about 0.001 to about 1 atomic % based on all the constituent atoms therein.

5. A photosensitive member as claimed in claim 1 wherein the charge generating layer further comprises nitrogen atoms in an amount of about 0.001 to about 3 atomic % based on all the constituent atoms therein.

6. A photosensitive member as claimed in claim 1 wherein the charge generating layer further comprises carbon atoms in an amount of about 0.001 to about 5 atomic % based on all the constituent atoms therein.

7. A photosensitive member as claimed in claim 1 wherein the amount of oxygen atoms contained in the charge transporting layer is about 0.1 to about 4.7 atomic % based on all the constituent atoms therein.

8. A photosensitive member as claimed in claim 1 wherein the amount of nitrogen atoms contained in the charge transporting layer is about 0.1 to about 3.9 atomic % based on all the constituent atoms therein.

9. A photosensitive member as claimed in claim 6, wherein said charge generating layer further comprises oxygen atoms in an amount of about 0.001 to about 1 atomic % based on all the constituent atoms therein.

10. A photosensitive member as claimed in claim 9, wherein said charge generating layer further comprises nitrogen atoms in an amount of about 0.001 to about 3 atomic % based on all the constituent atoms therein.

11. A photosensitive member as claimed in claim 5, wherein said charge generating layer further comprises nitrogen atoms in an amount of about 0.001 to about 3 atomic % based on all the constituent atoms therein.

* * * * *